US009347449B2

(12) United States Patent
Dane

(10) Patent No.: US 9,347,449 B2
(45) Date of Patent: May 24, 2016

(54) SUBMERSIBLE PUMP APPARATUS WITH MULTIPLE MECHANICAL SEALS AND MULTIPLE RESERVOIRS TO PROTECT THE MOTOR FROM INFILTRATION OF UNDESIRED FLUID

(71) Applicant: Willis Dane, Peru, IL (US)

(72) Inventor: Willis Dane, Peru, IL (US)

( * ) Notice: Subject to any disclaimer, the term of this patent is extended or adjusted under 35 U.S.C. 154(b) by 383 days.

(21) Appl. No.: 13/664,272

(22) Filed: Oct. 30, 2012

(65) Prior Publication Data

US 2014/0119958 A1 May 1, 2014

(51) Int. Cl.
*F04D 13/10* (2006.01)
*F04D 29/12* (2006.01)

(52) U.S. Cl.
CPC ..... *F04D 13/10* (2013.01); *F04D 29/126* (2013.01)

(58) Field of Classification Search
CPC ..... F04D 13/06; F04D 13/08; F04D 29/426; F04D 39/10; F04D 29/126
USPC ..... 417/423.3, 423.7, 423.11, 423.14
See application file for complete search history.

(56) References Cited

U.S. PATENT DOCUMENTS

| | | | | |
|---|---|---|---|---|
| 5,690,368 | A * | 11/1997 | Johnson | 285/205 |
| 6,224,354 | B1 * | 5/2001 | Brandt | F04D 29/128 277/428 |
| 6,287,074 | B1 * | 9/2001 | Chancellor | F04D 29/126 415/111 |
| 2007/0201994 | A1 * | 8/2007 | Itani | F04D 13/086 417/423.3 |
| 2009/0010773 | A1 * | 1/2009 | Parmeter | F04D 29/051 417/410.1 |
| 2011/0236233 | A1 * | 9/2011 | Merill | F04B 17/03 417/410.1 |

* cited by examiner

*Primary Examiner* — Justin Jonaitis
*Assistant Examiner* — Christopher Brunjes
(74) *Attorney, Agent, or Firm* — Knechtel, Demeur & Samlan

(57) ABSTRACT

A submersible pump apparatus comprising a motor assembly, a pump assembly, and a plastic motor base. The motor assembly is either a canned motor assembly or a four inch motor assembly. The canned motor assembly is designed to prevent the immediate destruction of the submersible pump apparatus upon the occurrence of the breaching or leaking of the seals. The pump assembly is designed with either a single stage pump or double stage pump that utilizes a unique combination of propellers and intermediate flow straighteners, and driving mechanisms for the same. The plastic motor base is designed to accommodate attachment of either the canned motor assembly or the four inch motor assembly to the same pump assembly.

13 Claims, 24 Drawing Sheets

SUBMERSIBLE PUMP APPARATUS WITH MULTIPLE MECHANICAL SEALS AND MULTIPLE RESERVOIRS TO PROTECT THE MOTOR FROM INFILTRATION OF UNDESIRED FLUID

I. CROSS-REFERENCE TO RELATED APPLICATION

Not applicable.

II. FIELD OF THE INVENTION

The present invention relates to submersible pumps and, more particularly, to a new and improved submersible pump apparatus.

III. DESCRIPTION OF THE PRIOR ART

Submersible pumps have been around in the public domain for many years. A typical submersible pump is a device that has a hermetically sealed motor coupled with a pump and a discharge assembly. The entire submersible pump is submerged in a fluid such as water, oil, or other fluid depending upon the application and use, and then used to pump this fluid to the surface. Submersible pumps are used in many applications such as circulation or aeration devices commonly used for creating directional flow in a pond or lake to turn still, create stagnant water into a stream environment, and/or also create a fountain or other visual water displays and designs. As a result, these types of submersible pumps help, among other benefits, to add vital oxygen to the water and improve the pond or lake aeration; reduce aquatic plant growth and inhibit mosquito reproduction; and/or protect permanent fixtures in the water such as docks.

However, considering the conditions under which these types of submersible pumps operate, submersible pumps also experience some inherent problems. For example, once installed, these submersible pumps remain and are operated completely submerged in the fluid. Although the motors contained in the submersible pump are hermetically sealed, submersible pumps are subjected to a constant presence of, and surrounded by, fluid (e.g., such as water). Upon the gradual wearing down of the mechanical seals, this presence of fluid unfortunately will breach or leak through the seals and cause the destruction of the submersible pumps. Although another submersible pump can simply replace the one just destroyed, the continued, more frequent replacement of these submersible pumps is an expense that can be avoided or delayed if the submersible pump is designed to account for the breach in the seals to prevent the immediate destruction of the submersible pump.

Accordingly, Applicant's new and improved inventive submersible pump apparatus solves these and other problems. Thus, there is a need and there has never been disclosed Applicant's unique submersible pump.

IV. SUMMARY OF THE INVENTION

The present invention is a submersible pump apparatus comprising a motor assembly, a pump assembly, and a plastic motor base. The motor assembly is either a canned motor assembly or a four inch motor assembly. The canned motor assembly is designed to prevent the immediate destruction of the submersible pump apparatus upon the occurrence of the breaching or leaking of the seals. The pump assembly is designed with either a single stage pump or double stage pump that utilizes a unique combination of propellers and intermediate flow straighteners, and driving mechanisms for the same. The plastic motor base is designed to accommodate attachment of either the canned motor assembly or the four inch motor assembly to the same pump assembly.

V. BRIEF DESCRIPTION OF THE DRAWINGS

The Description of the Preferred Embodiment will be better understood with reference to the following figures.

Figure 5A:
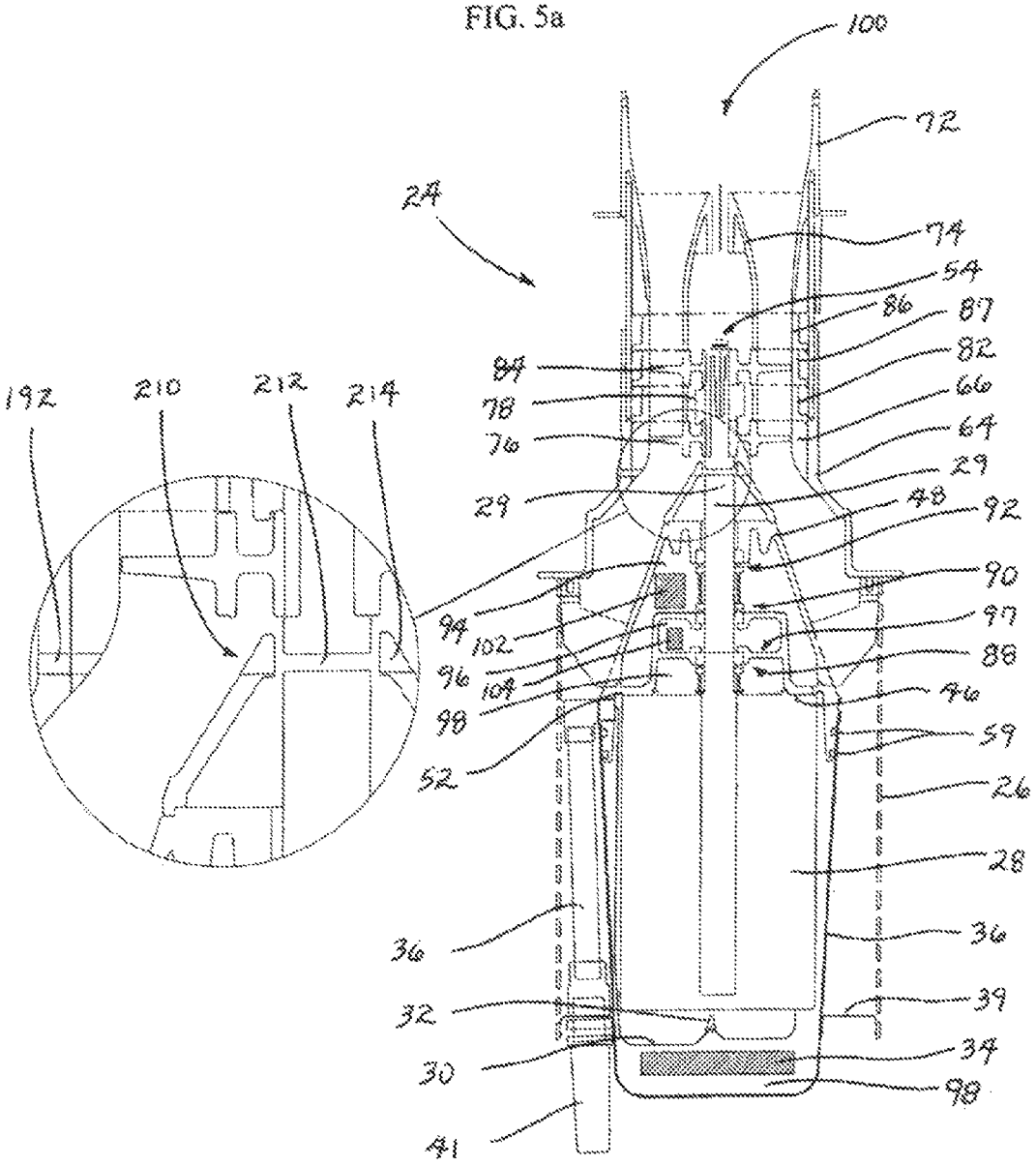

FIG. 5*a* is a cross-sectional view of the submersible pump apparatus illustrating, in particular, the canned motor assembly and the pump assembly.

Figure 5B:
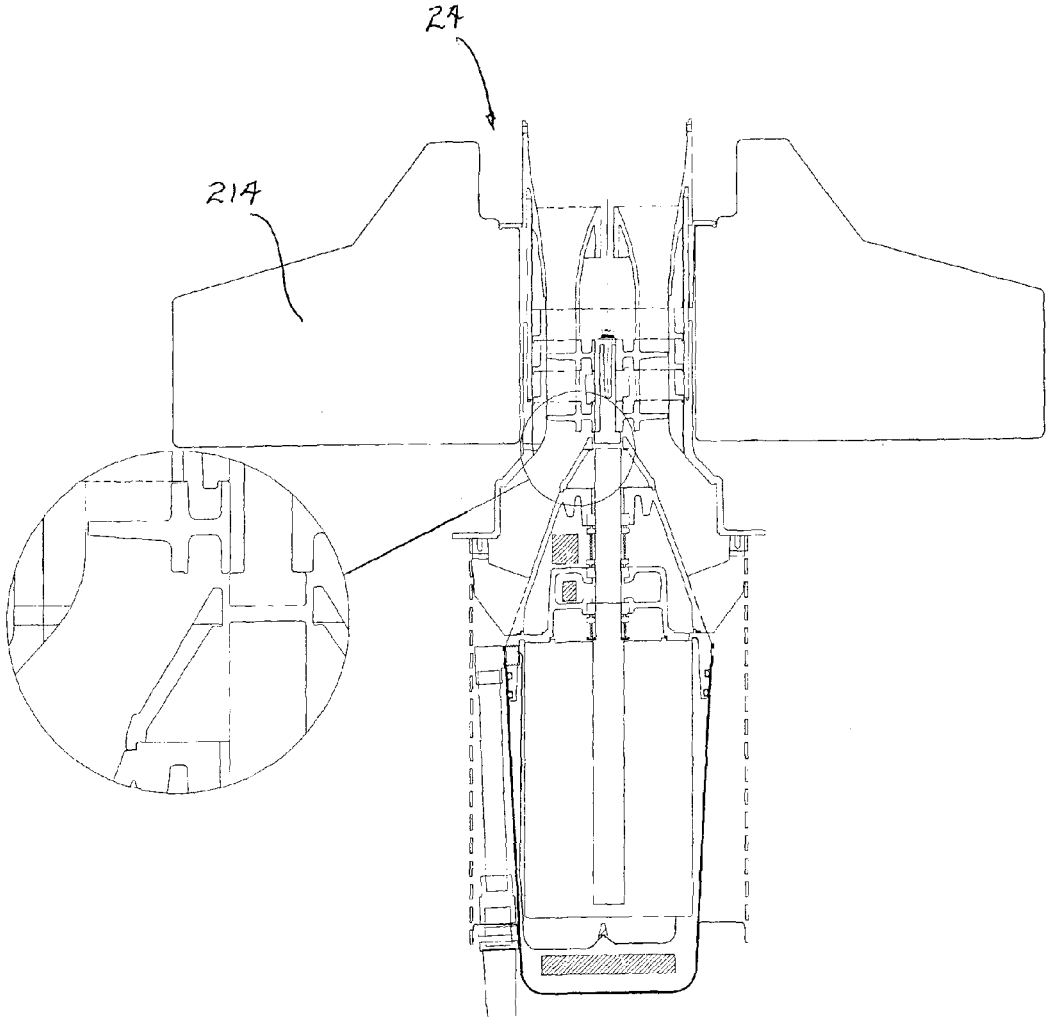

FIG. 5*b* is a cross-sectional view of the submersible pump apparatus illustrating, in particular, the canned motor assembly and the pump assembly as attached to a float for use as a floatation fountain.

Figure 6:
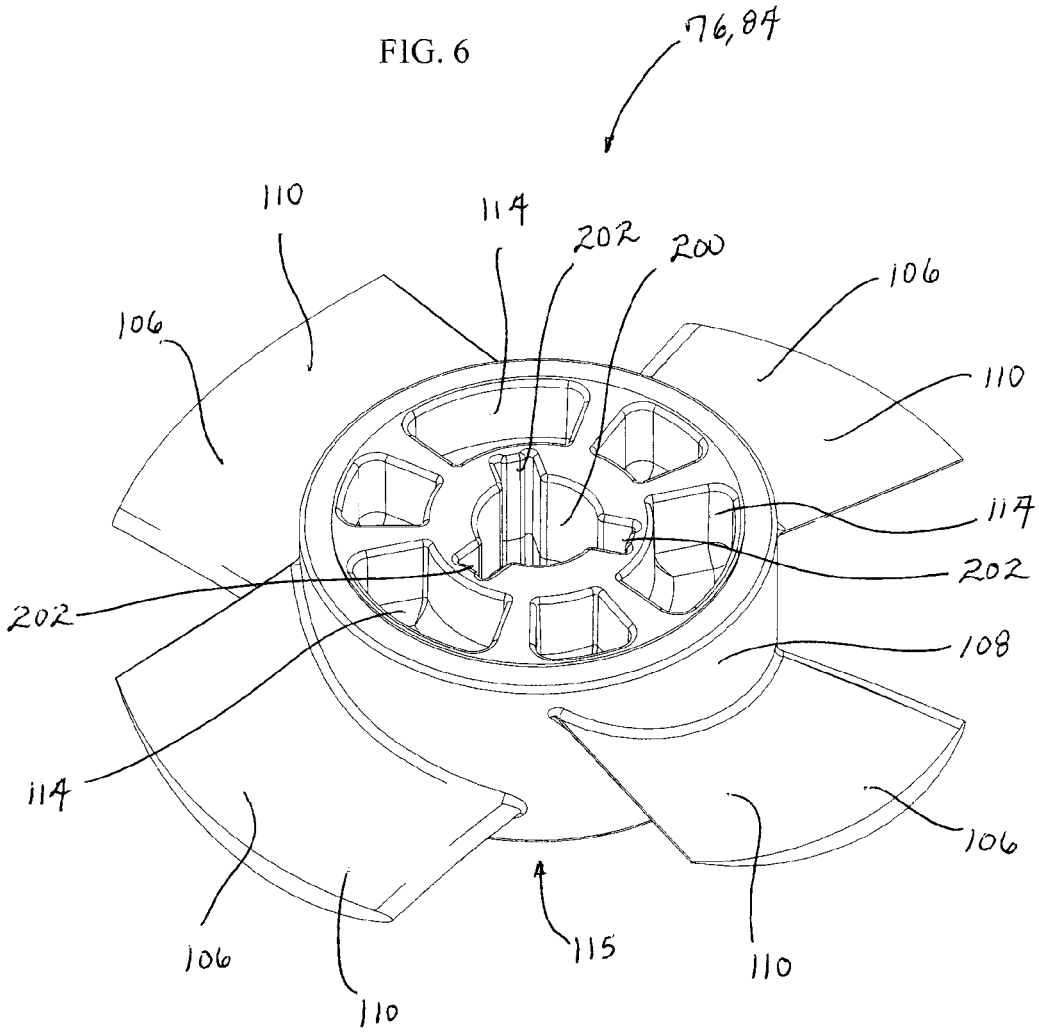

FIG. 6 is a side perspective view of the propeller for the pump assembly.

Figure 7:
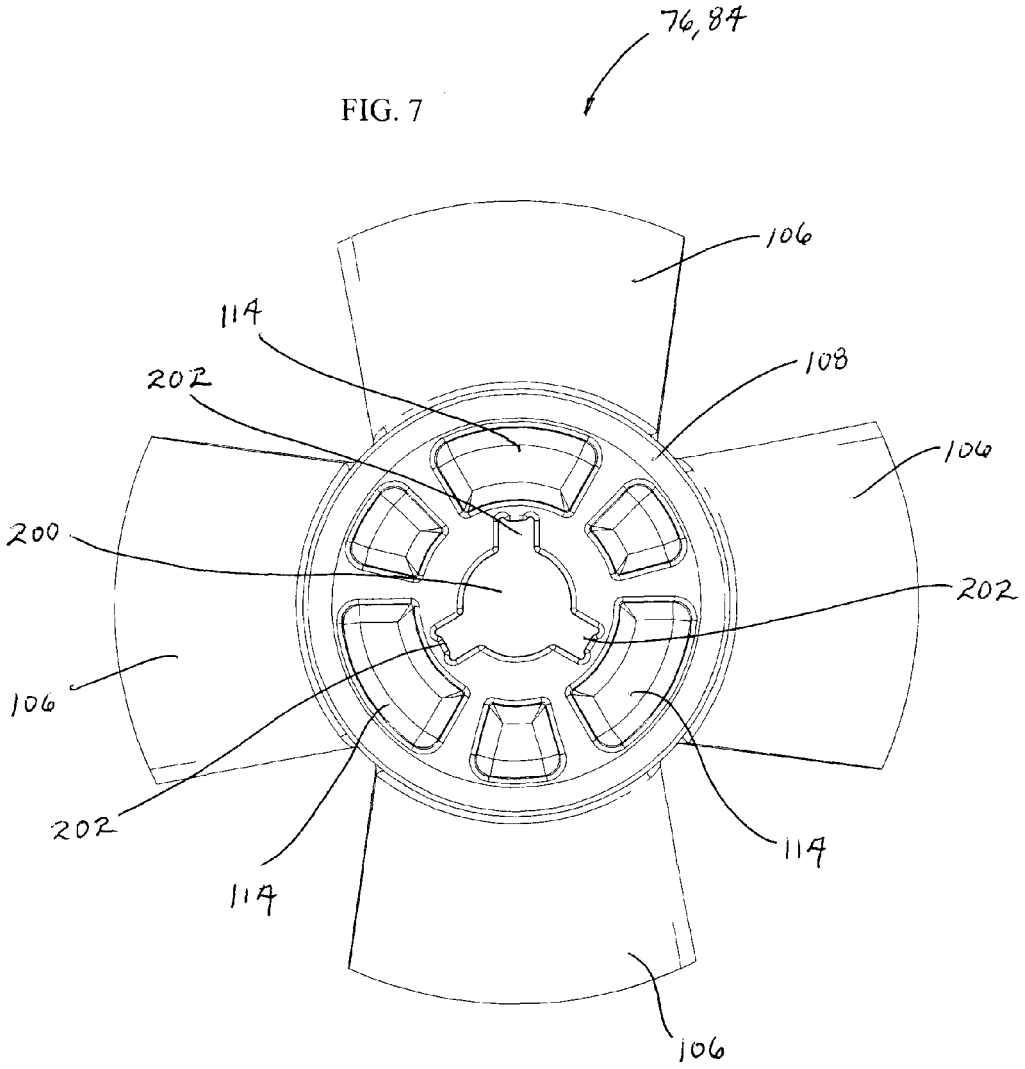

FIG. 7 is a top view of the propeller for the pump assembly.

Figure 8:
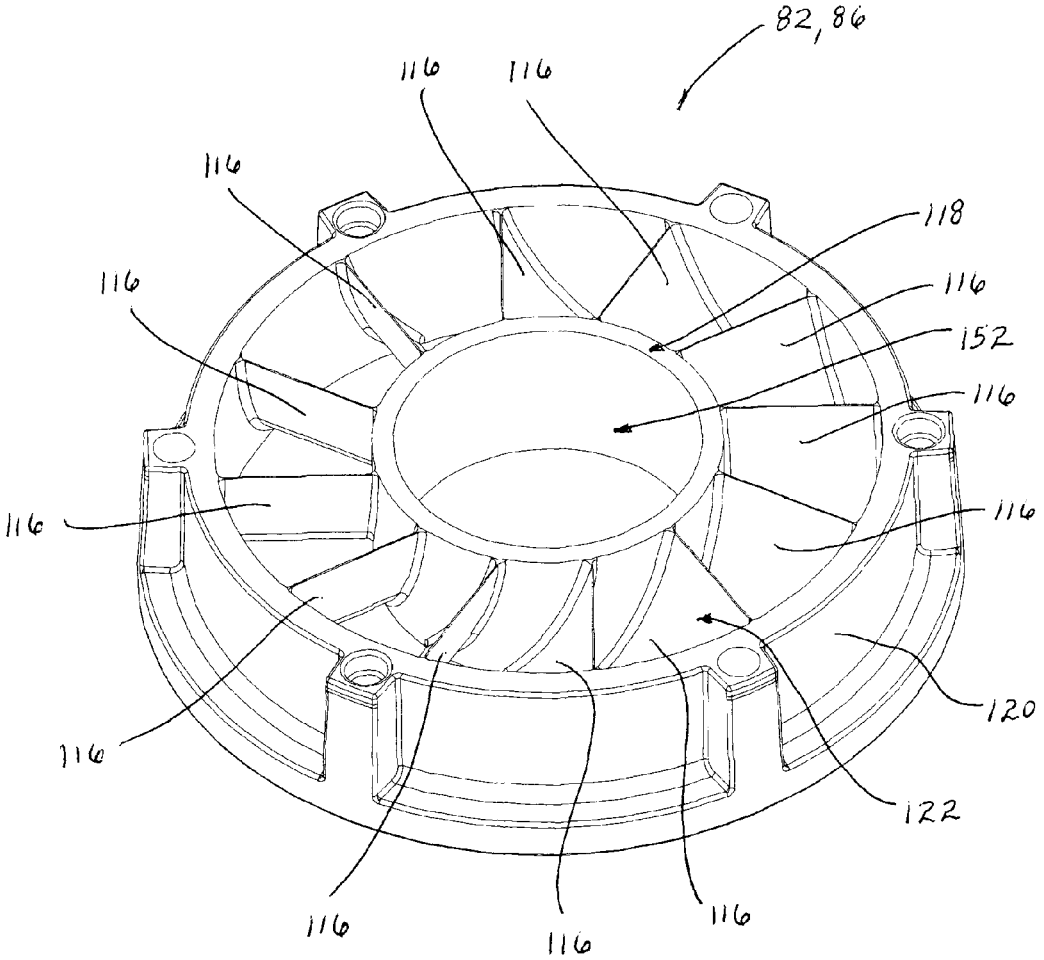

FIG. 8 is a side perspective view of the intermediate flow straightener for the pump assembly.

Figure 9:
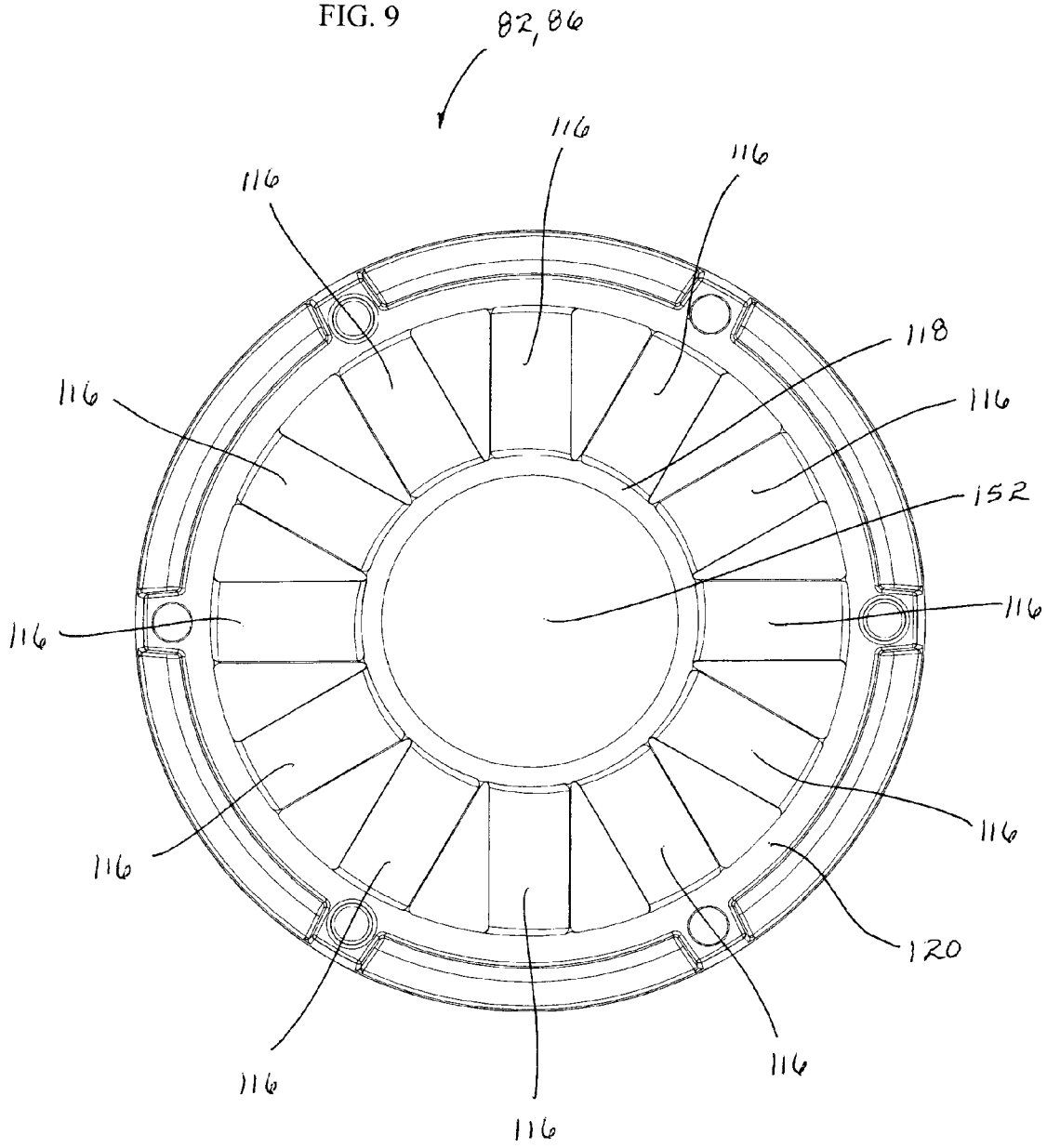

FIG. 9 is a top view of the intermediate flow straightener for the pump assembly.

Figure 10:
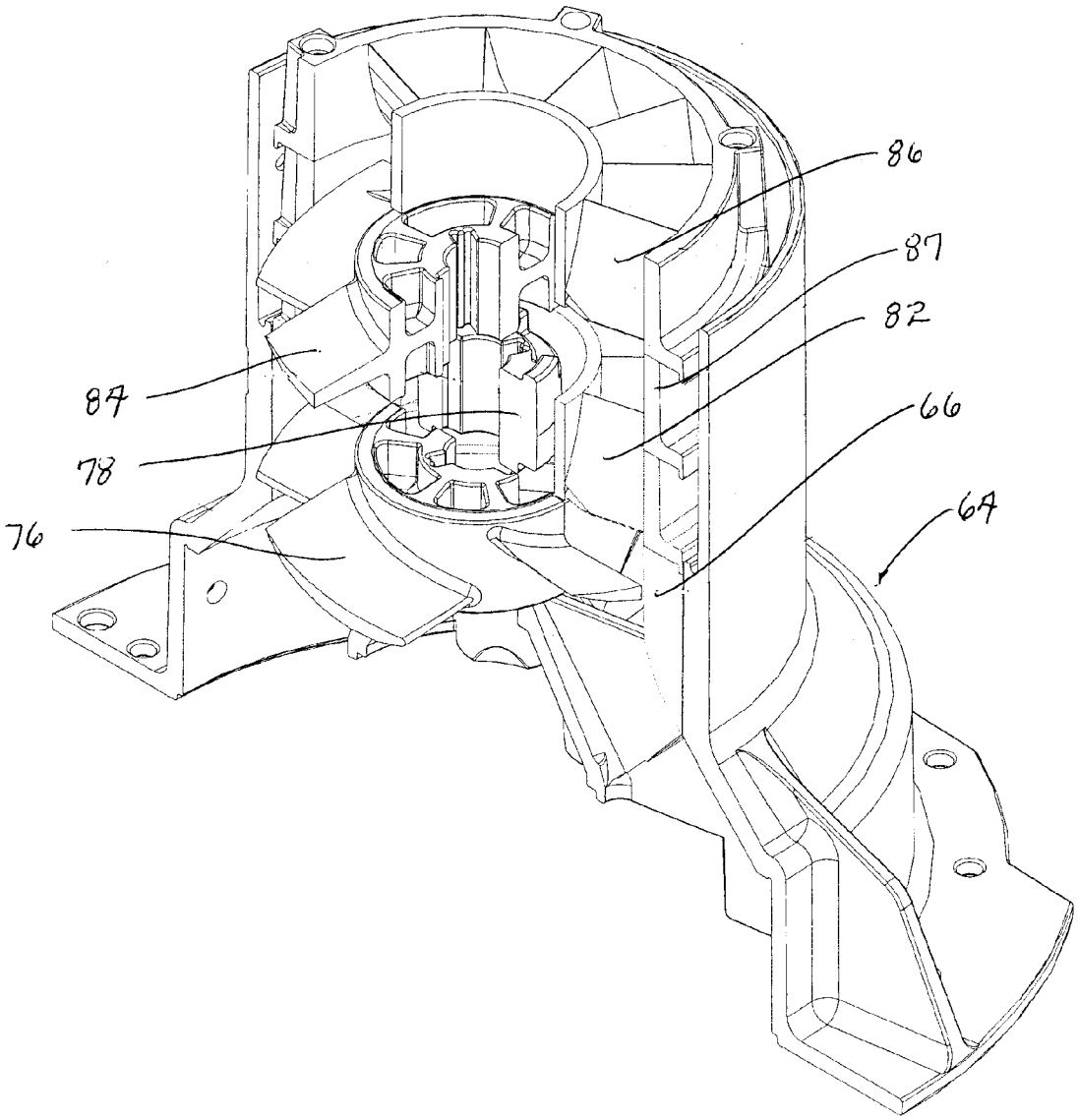

FIG. 10 is a cross-sectional view, with portions removed, of the double stage pump of the pump assembly.

Figure 11:
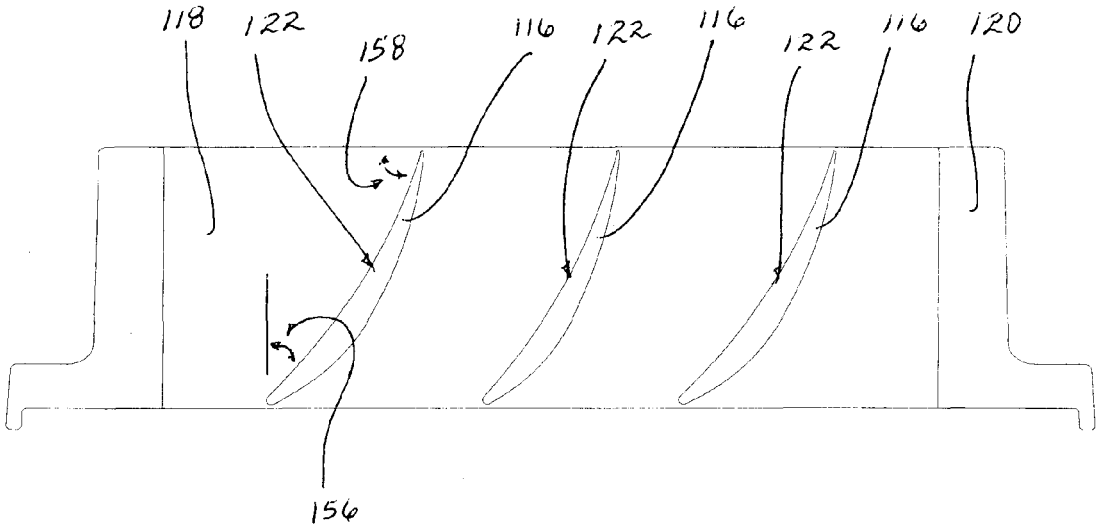

FIG. 11 is a partial cross sectional view, with portions removed, of the vanes in the intermediate flow straightener for the pump assembly.

Figure 12:
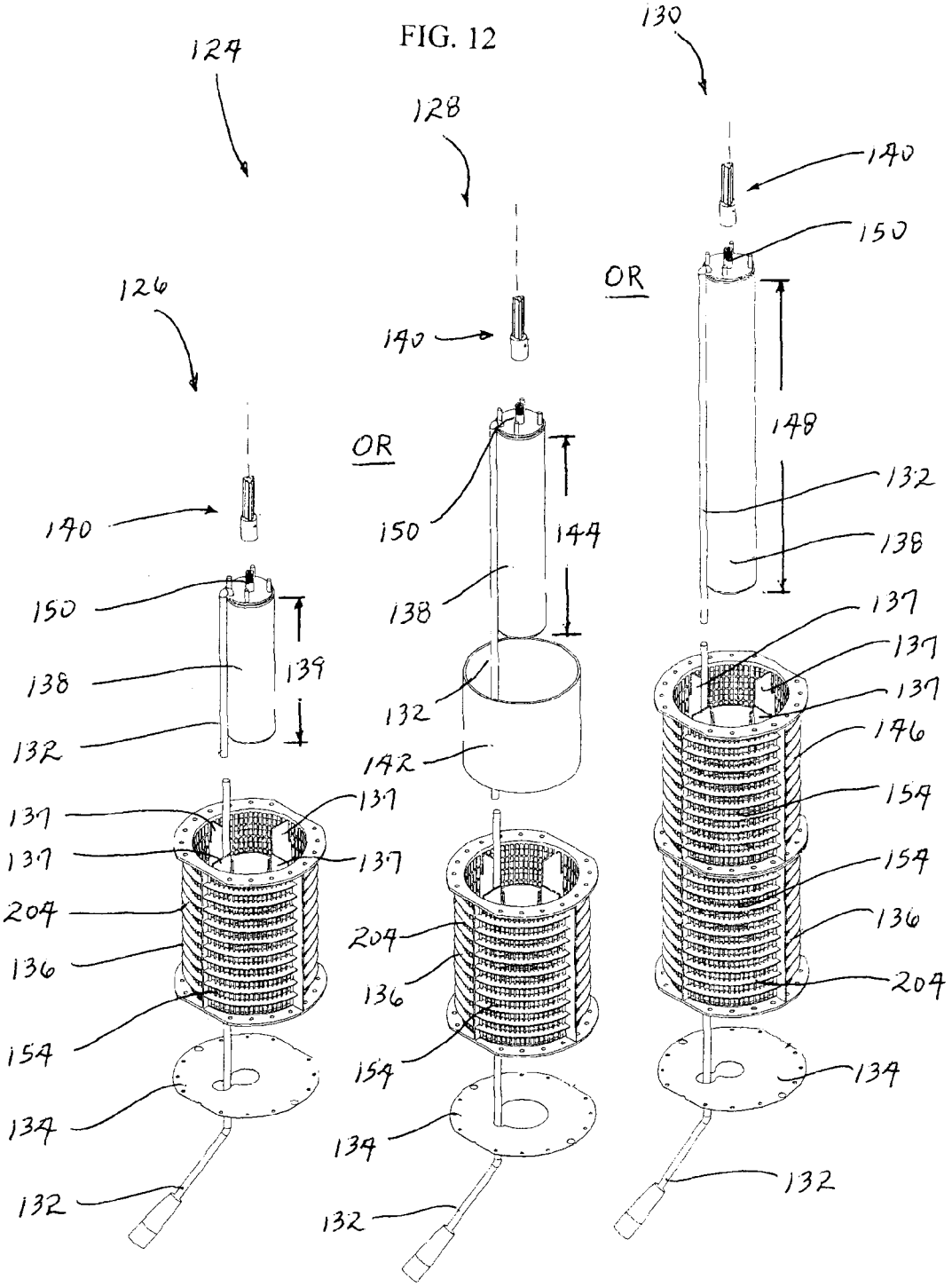

FIG. 12 is an exploded perspective view of an alternate embodiment motor assembly and, in particular, illustrating a short motor assembly, a medium motor assembly, and a long motor assembly.

Figure 13:
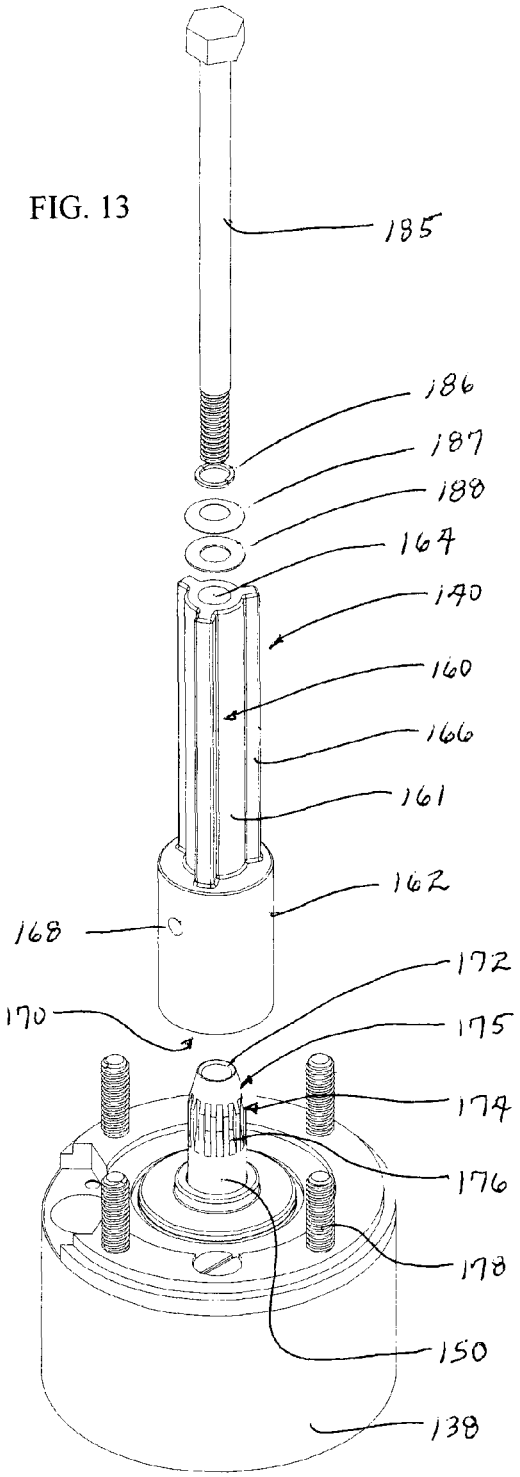

FIG. 13 is an exploded perspective view of the shaft extension for attachment to the motor.

Figure 14:
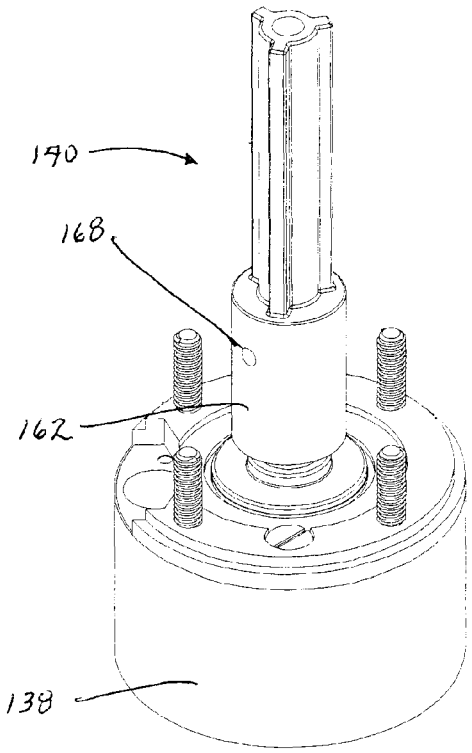

FIG. 14 is a side perspective view of the shaft extension as secured to the motor.

Figure 15:
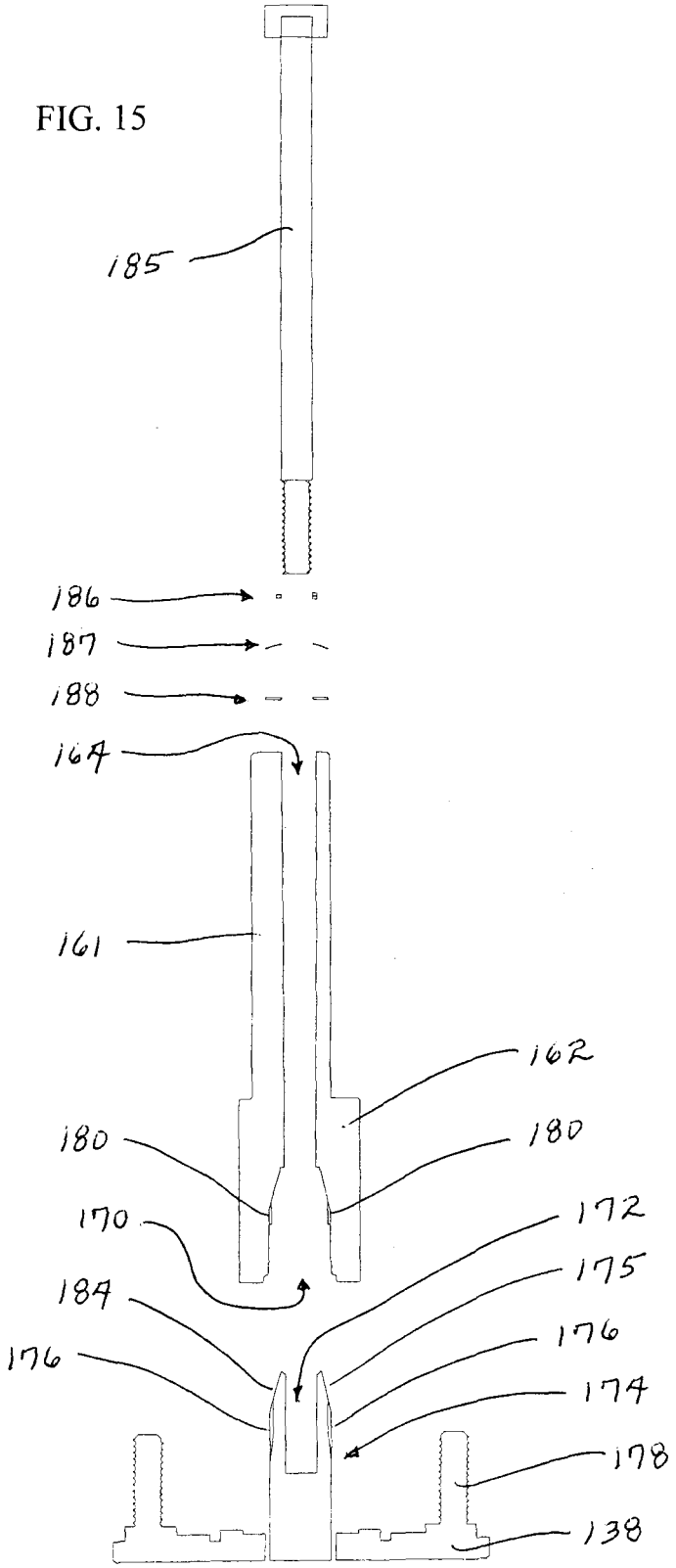

FIG. 15 is an exploded cross-sectional view of both the shaft extension and the top of the motor.

Figure 16:
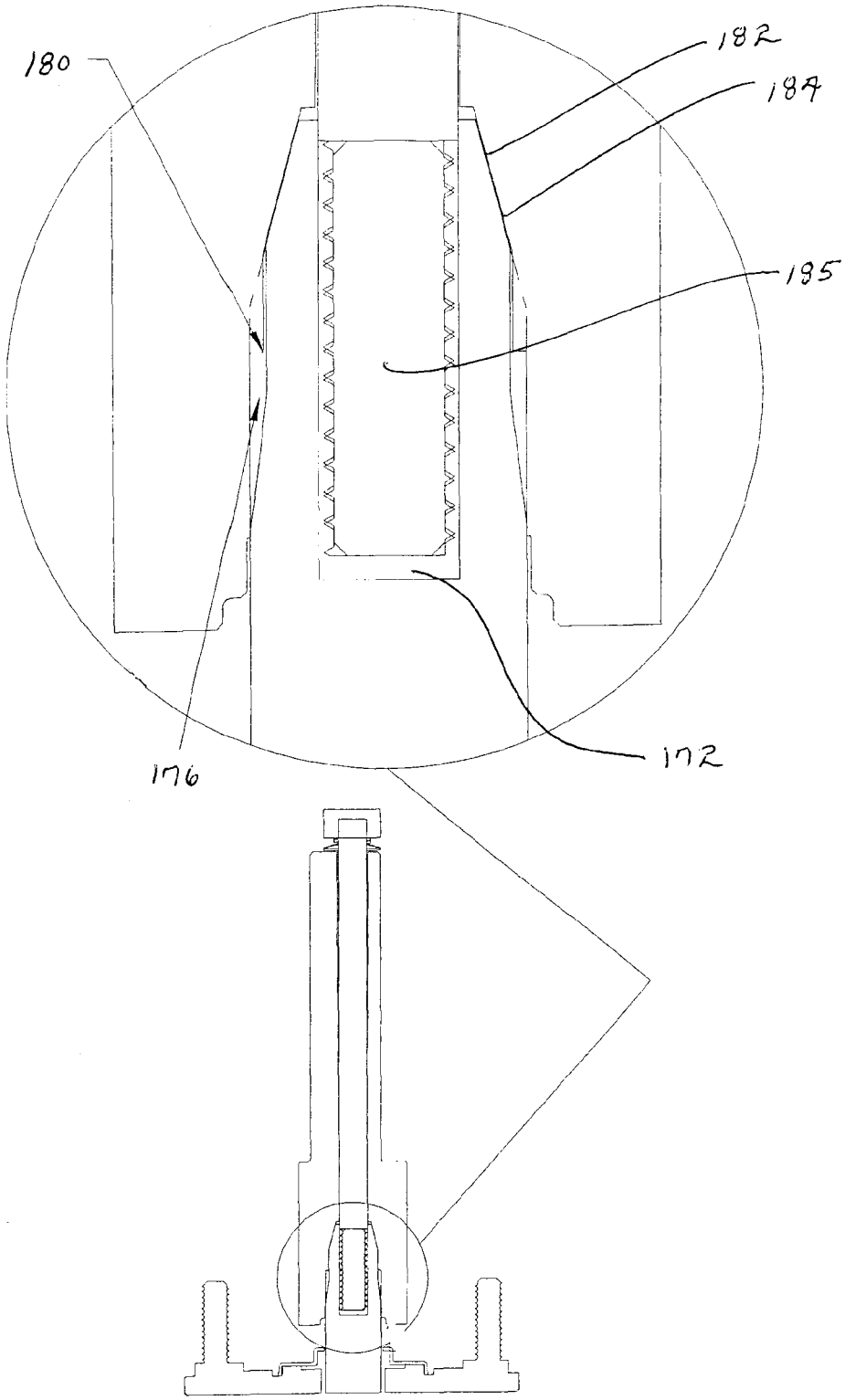

FIG. 16 is a cross-sectional view of the shaft extension as fixedly secured to the motor shaft of the motor.

Figure 17A:
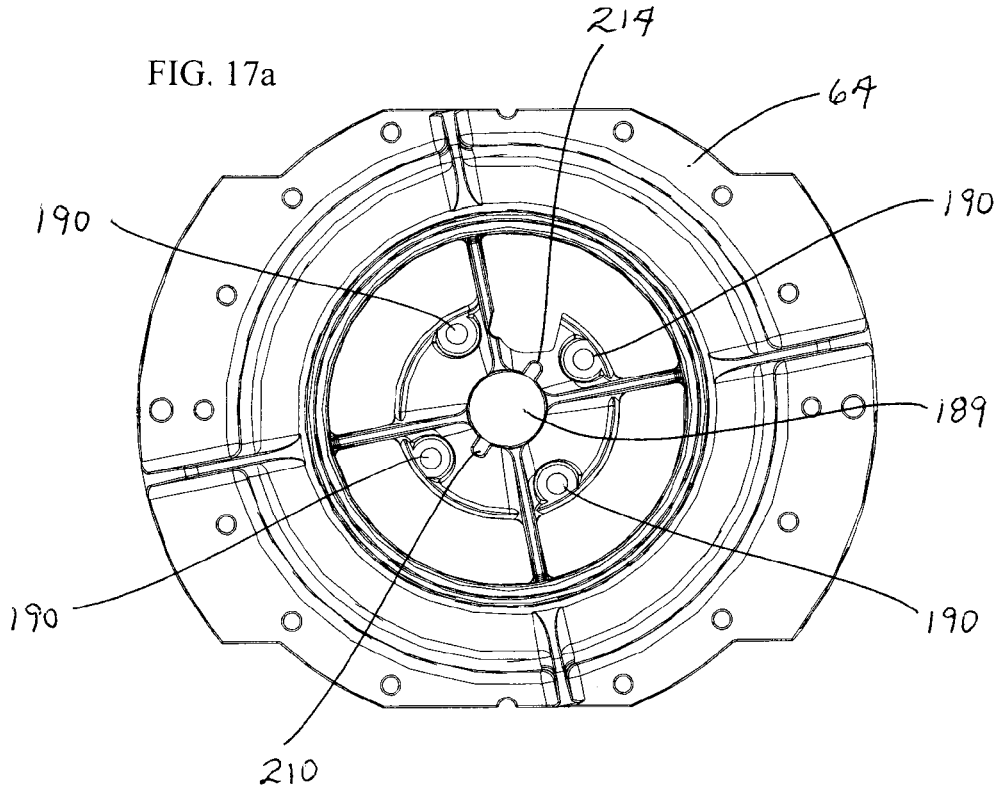

FIG. 17*a* is a top view of the plastic motor base.

Figure 17B:
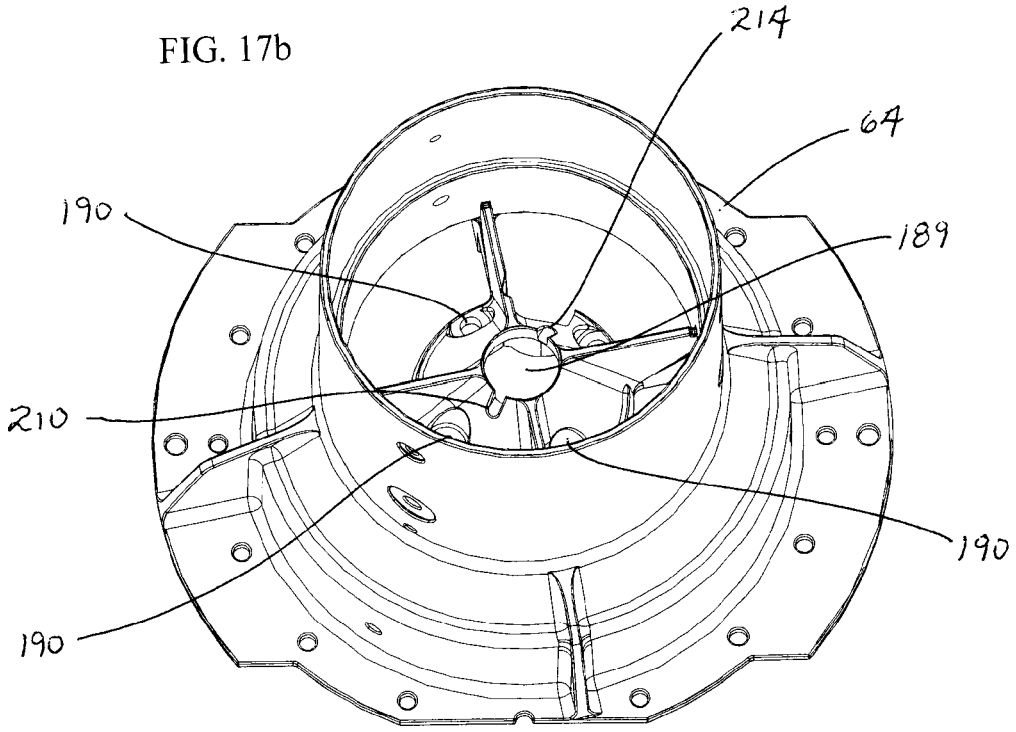

FIG. 17*b* is an isometric view from the top of the plastic motor base.

Figure 17C:
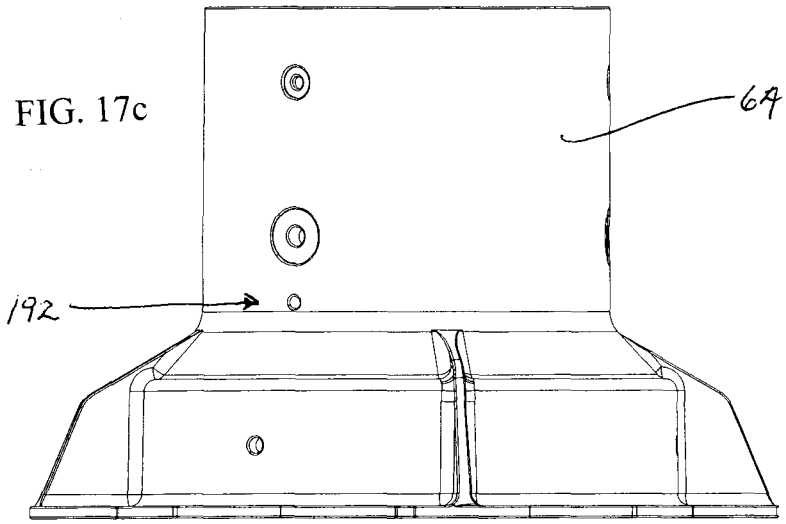

FIG. 17*c* is a side view of the plastic motor base.

Figure 17D:
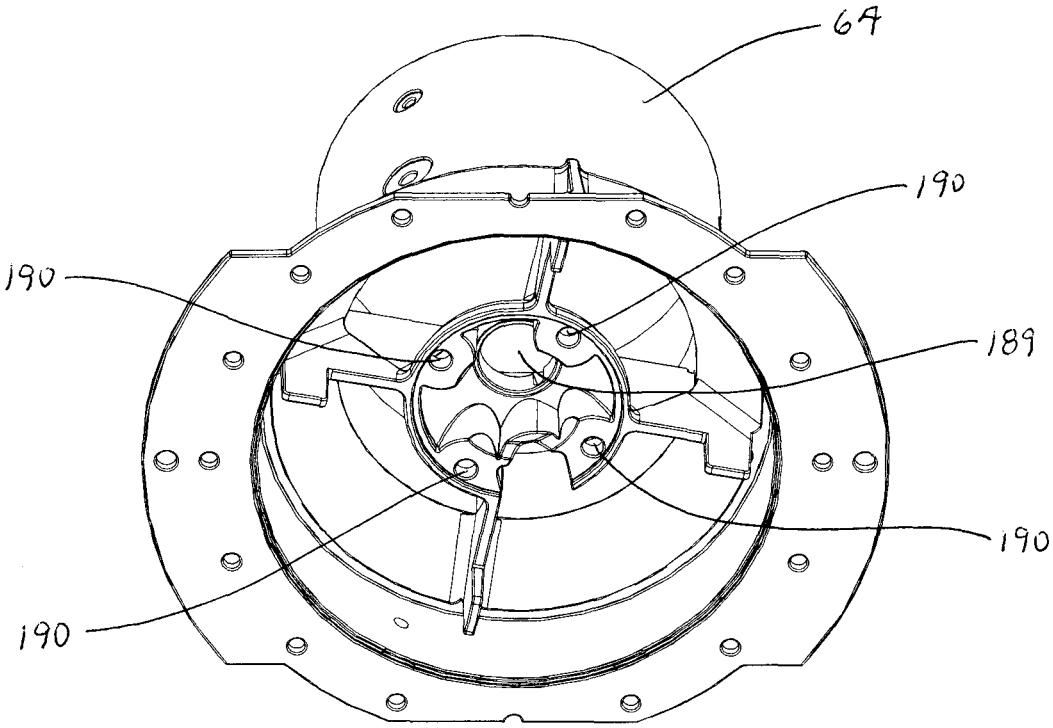

FIG. 17*d* is an isometric view from the bottom of the plastic motor base.

Figure 18:
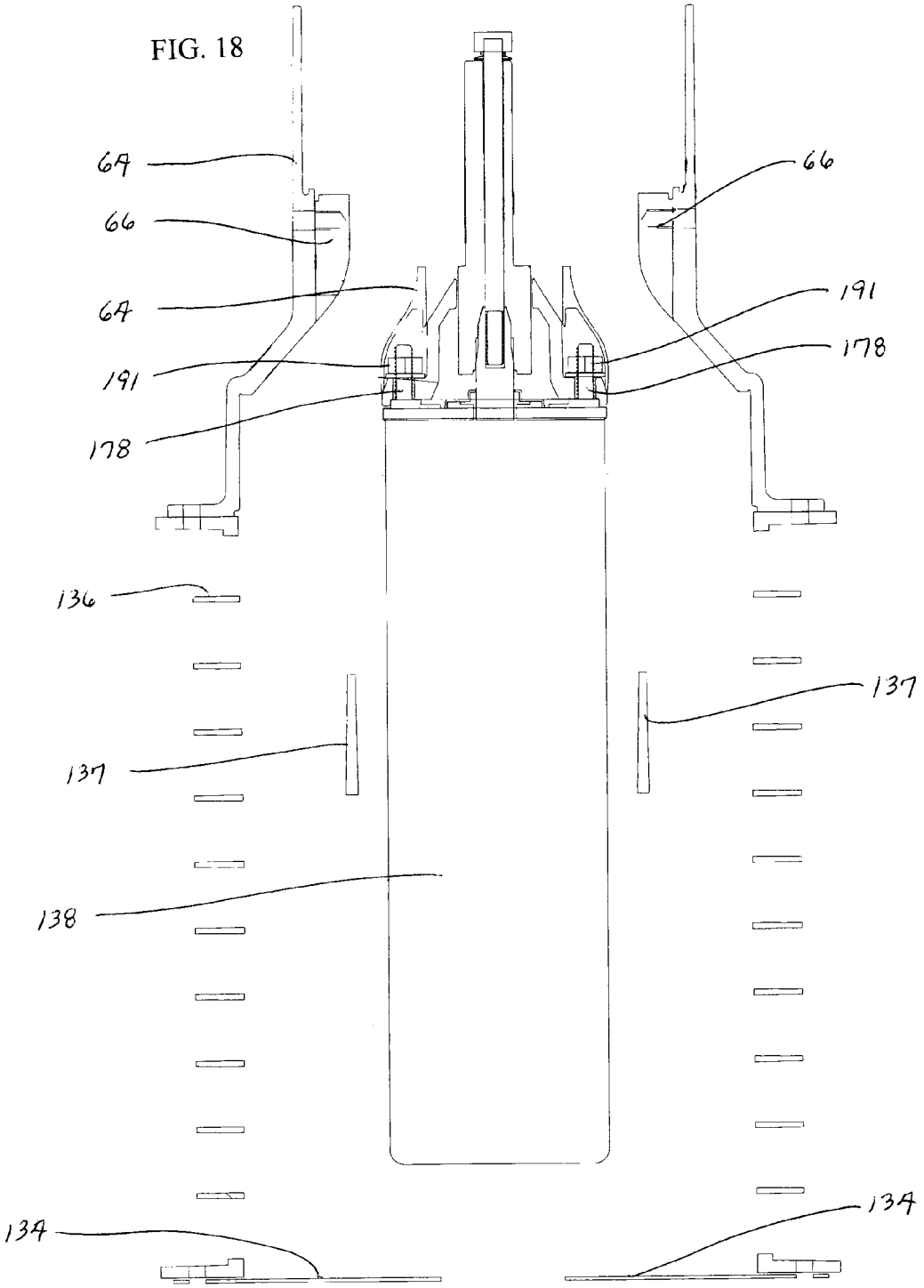

FIG. 18 is a cross sectional view of the plastic motor base as fixedly secured to the motor assembly and the shaft extension as fixedly secured to the motor shaft of the motor.

Figure 19:
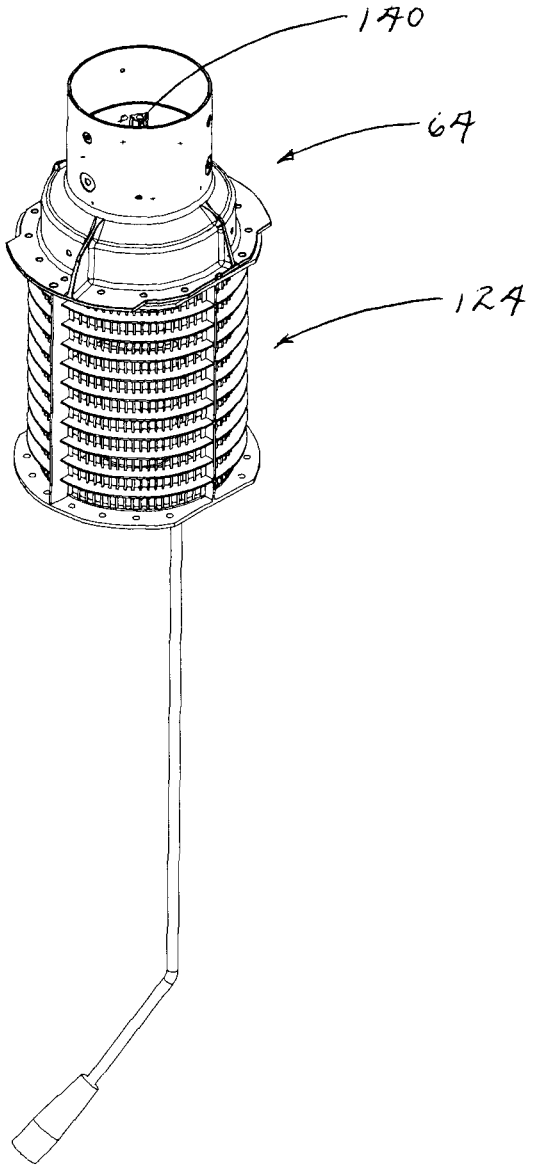

FIG. 19 is a side perspective view of the plastic motor base as assembled to the motor assembly.

Figure 20:
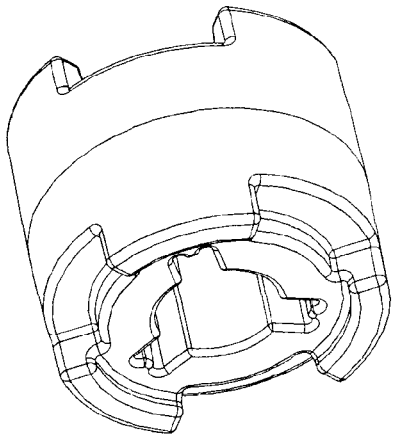
Figure 20:
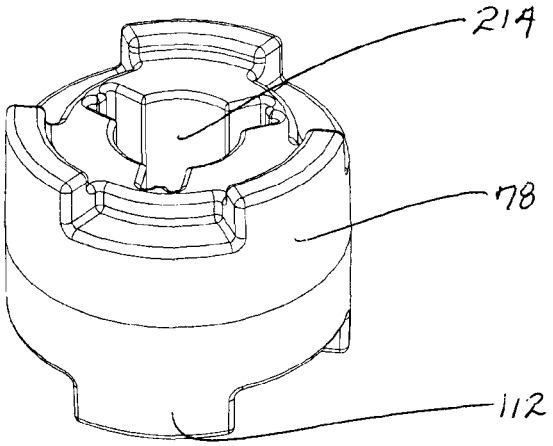
Figure 20:
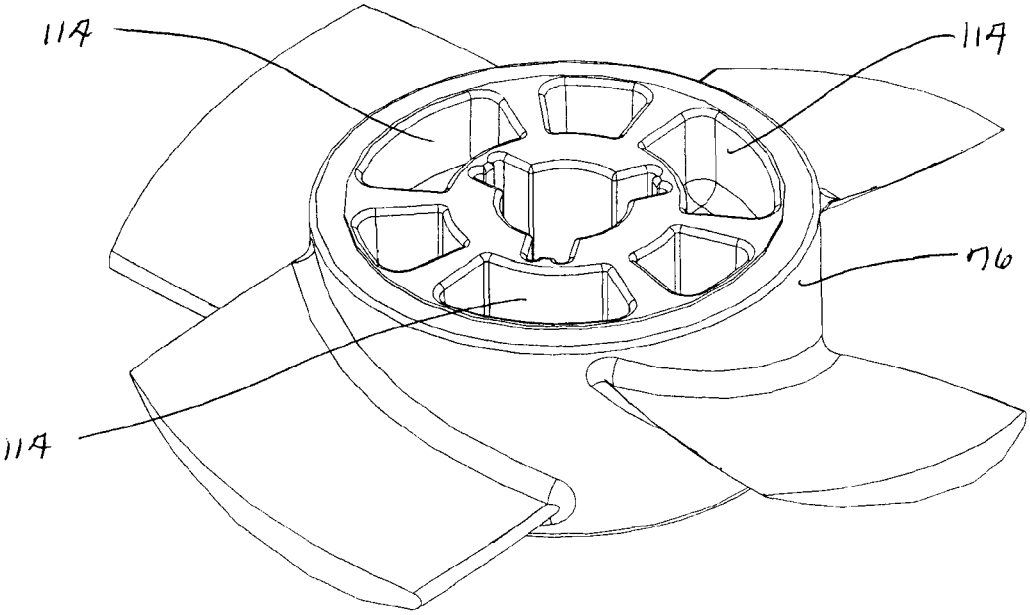

FIG. 20 is an exploded perspective view illustrating, in either the single stage or double stage pump, the propeller spacer prior to being releaseably assembled to the propeller.

Figure 21:
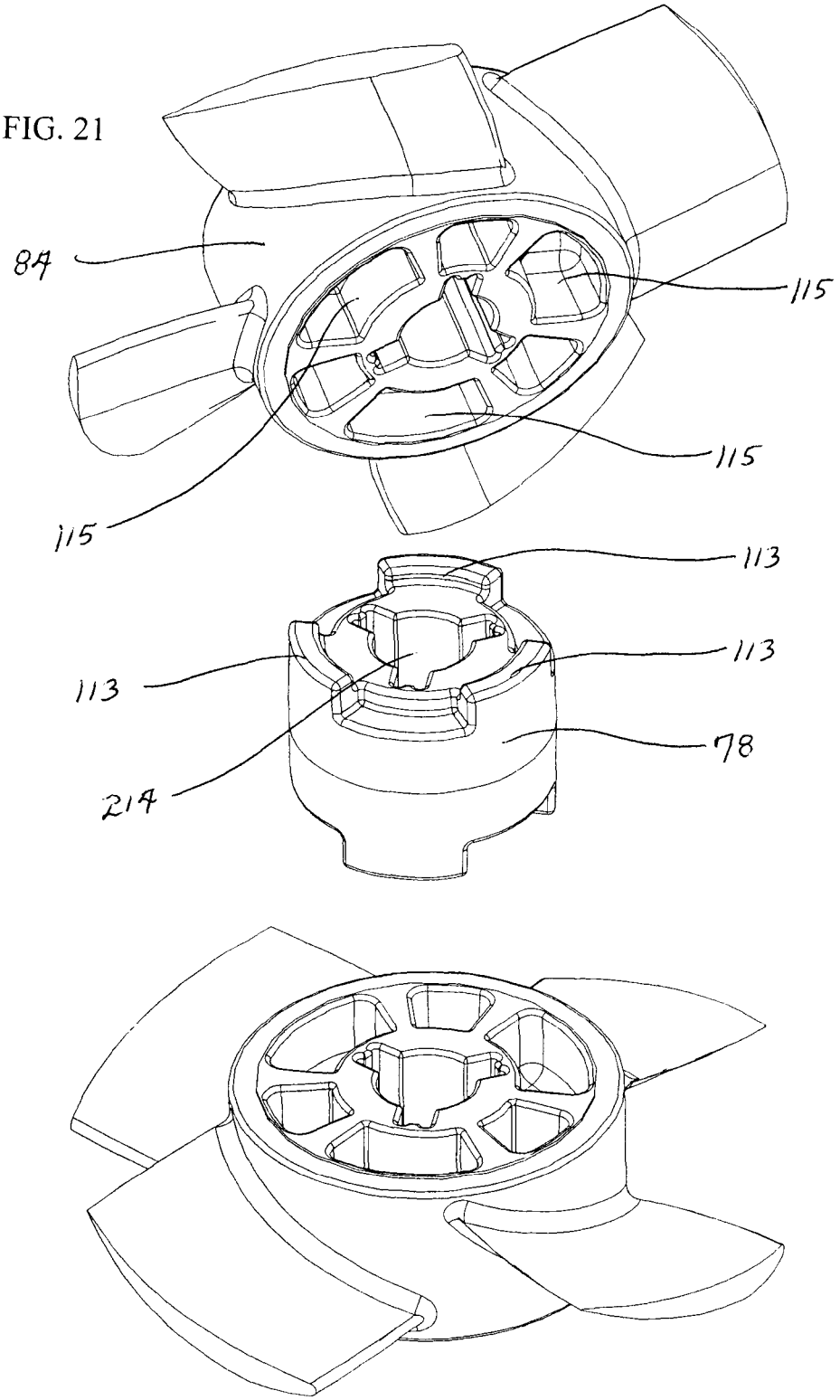

FIG. 21 is an exploded perspective view illustrating, in the double stage pump, the propeller spacer prior to being releaseably assembled to the second propeller.

Figure 22:
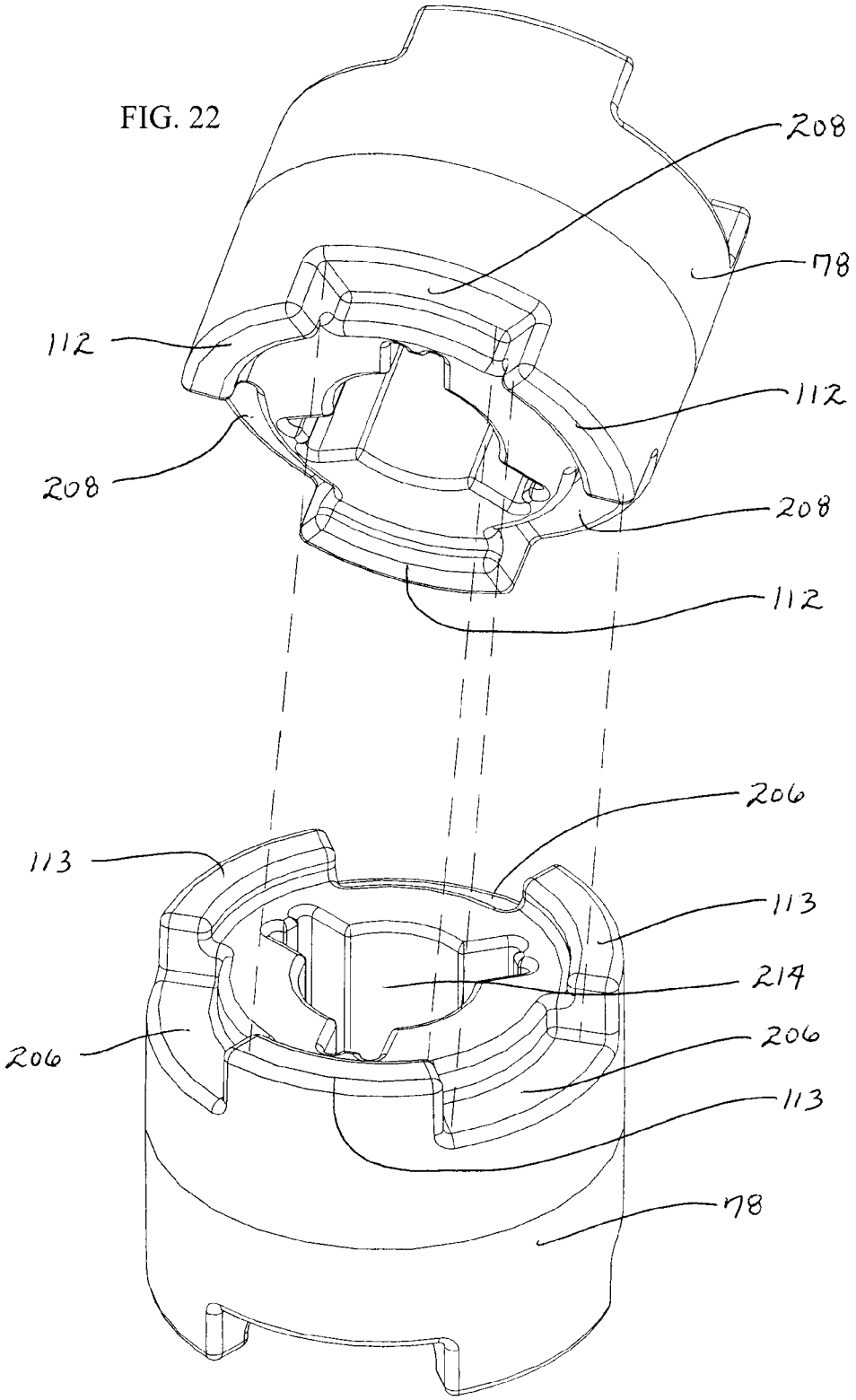

FIG. 22 is an exploded perspective view illustrating, in the single stage pump, the assembly of both of the propeller spacers to one another.

Figure 23:
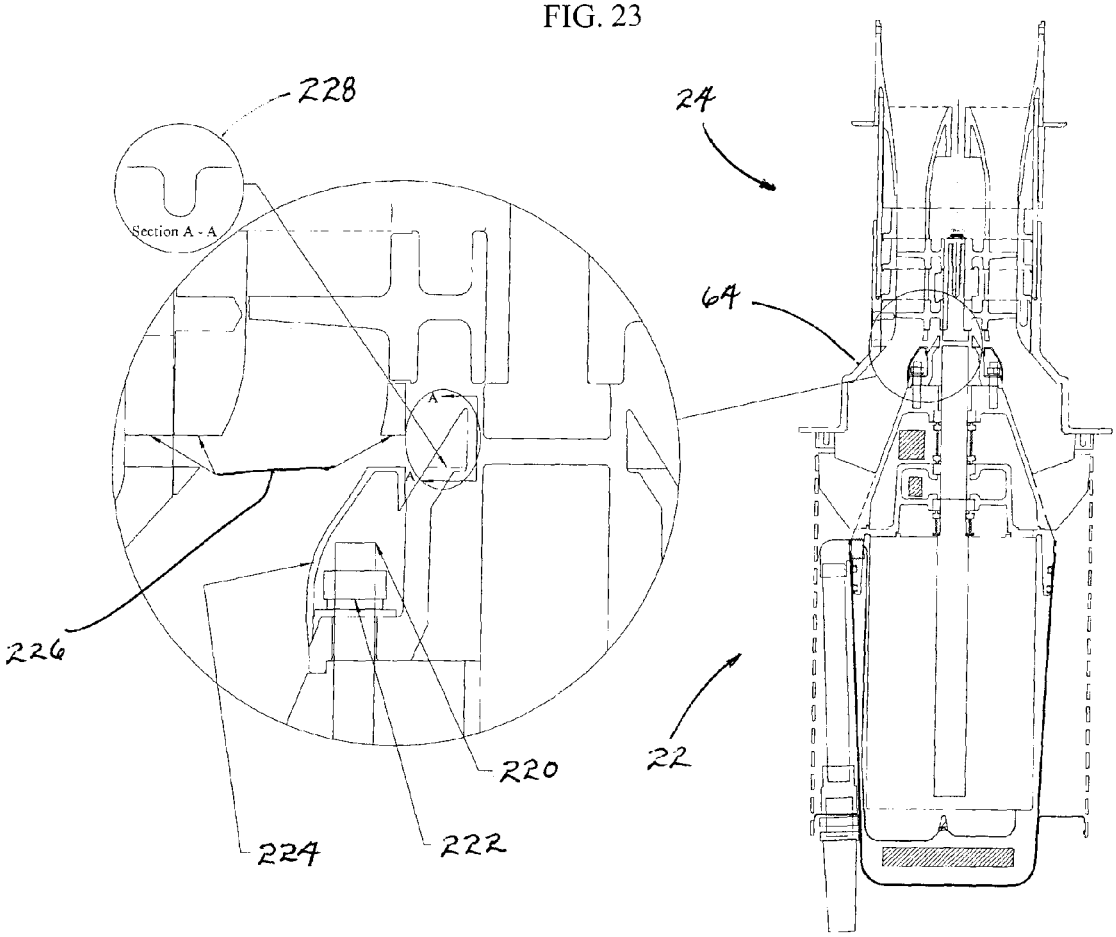

FIG. 23 is a cross-sectional view of the submersible pump apparatus illustrating, in particular, the plastic motor base securing the canned motor assembly to the pump assembly.

VI. DETAILED DESCRIPTION OF THE PREFERRED EMBODIMENT

Figure 1:
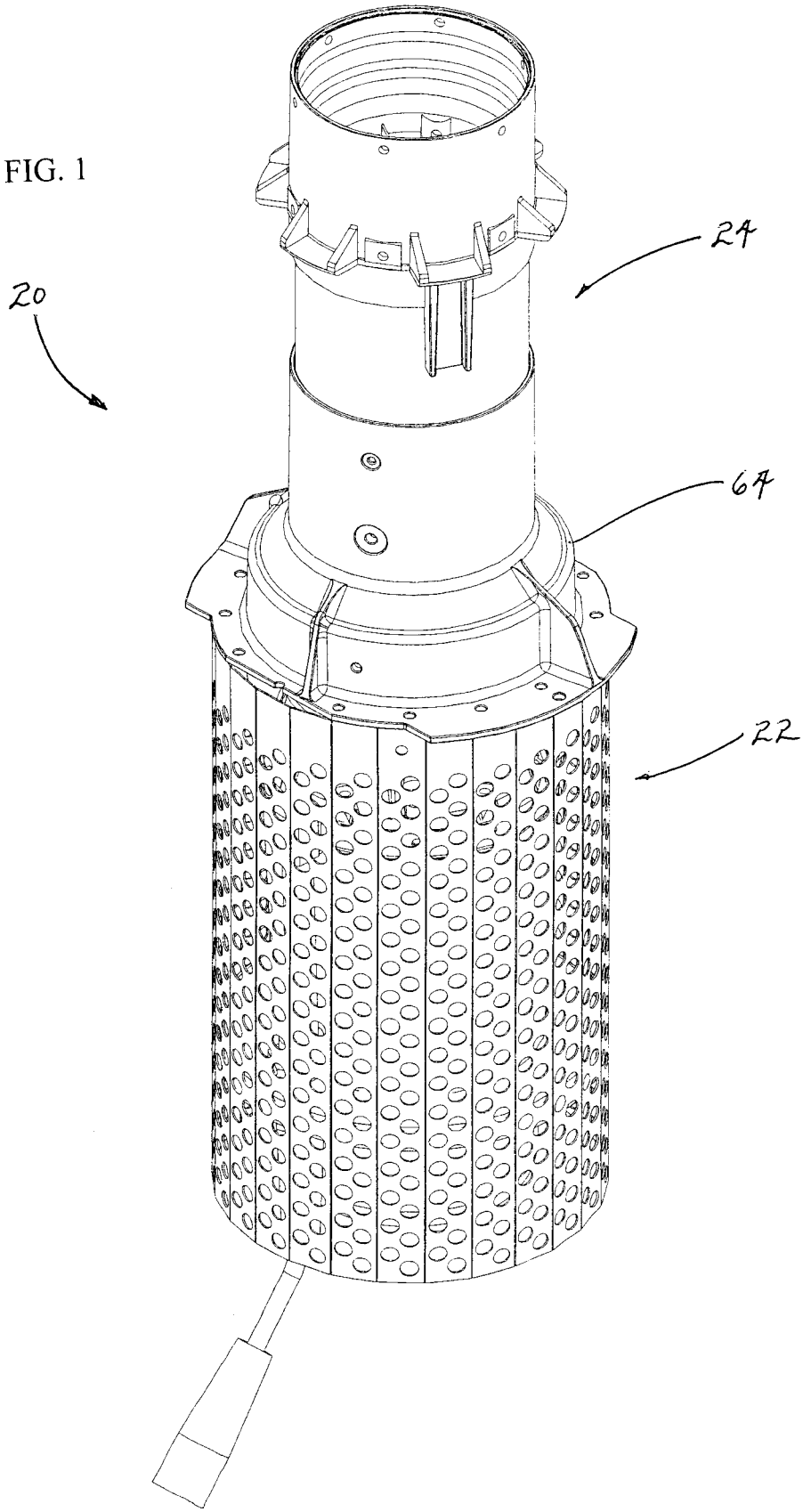
FIG. 1 is a side perspective view of Applicant's submersible pump apparatus.
Figure 2:
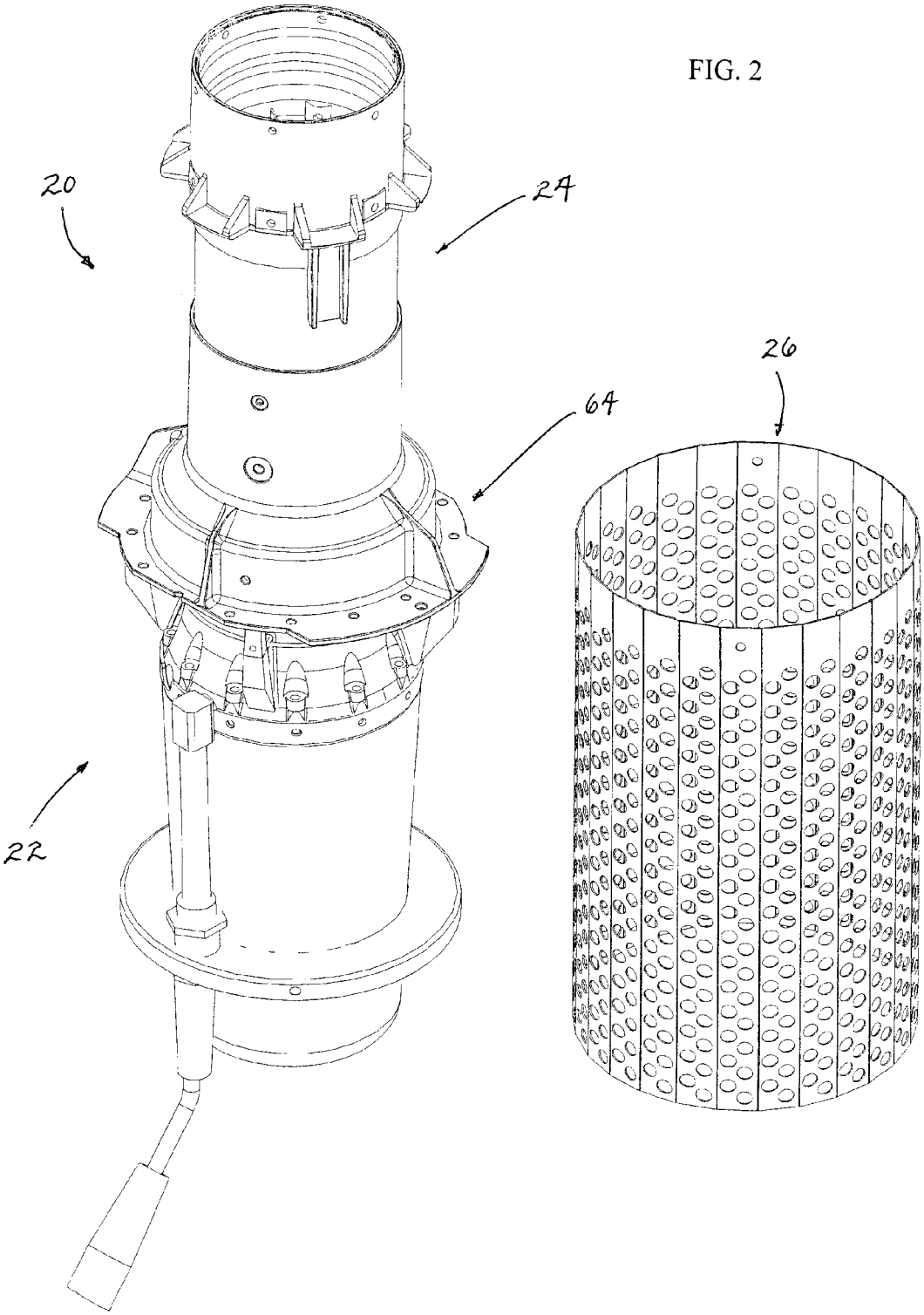
FIG. 2 is a side perspective view of the submersible pump apparatus illustrating, in particular, the canned motor assembly as connected to the pump assembly with the suction screen as detached.

Turning first to FIG. 1, there is illustrated a submersible pump apparatus 20. The submersible pump 20 comprises a canned motor assembly 22 and a pump assembly 24. The canned motor assembly 22, in its assembled form with a suction screen 26 detached, is also illustrated in FIG. 2. In the preferred embodiment, the canned motor assembly 22 is fixedly secured to the pump assembly 24 through the use of a plastic motor base 64. This is also more clearly illustrated in FIG. 23, in which threaded studs 220, hex nut 222, a motor fairing 224, lock pin holes 226, and a lock pin slot 228 are used to accomplish the attachment.

Figure 3:
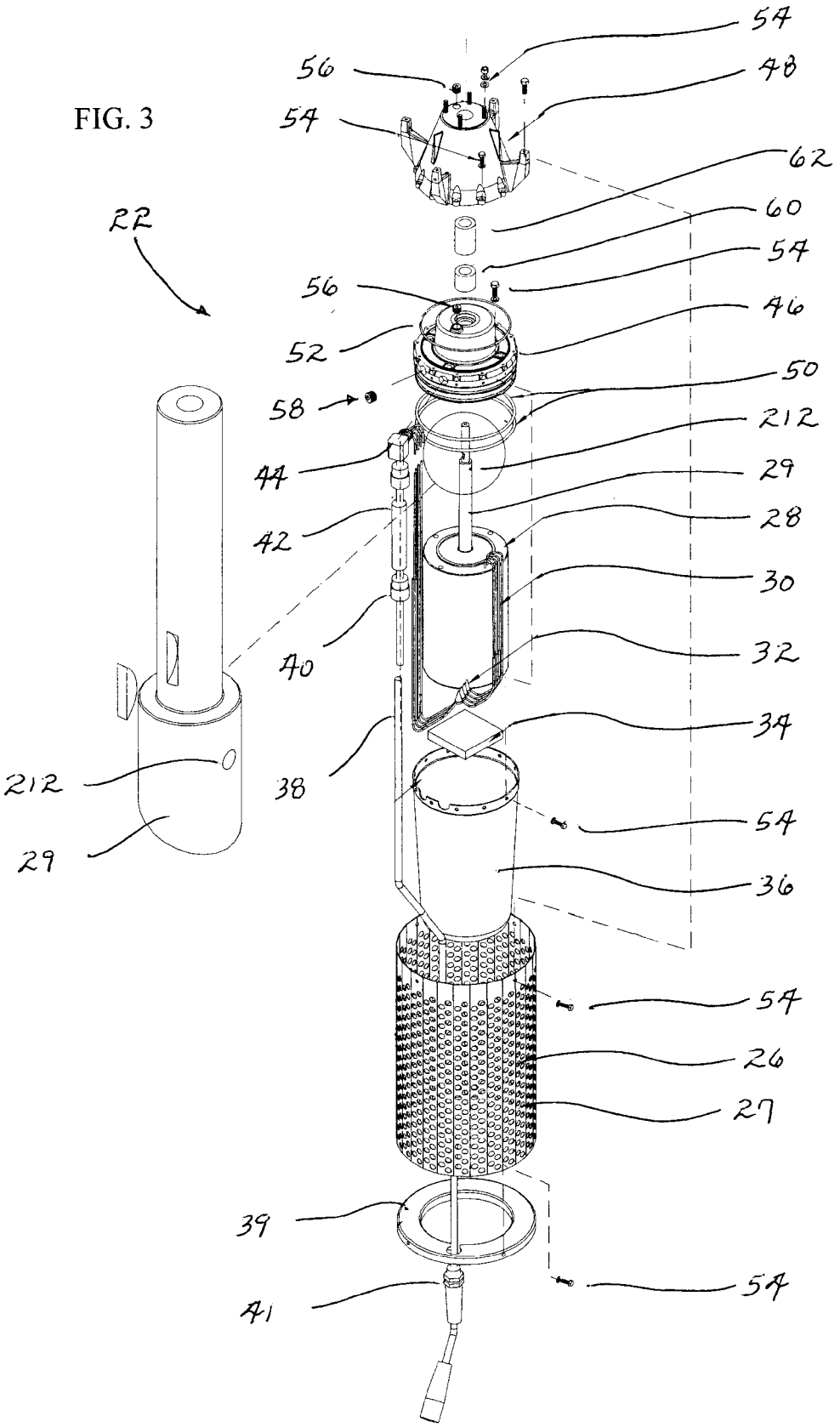
FIG. 3 is an exploded perspective view of the submersible pump apparatus illustrating, in particular, the canned motor assembly.

The canned motor assembly 22, and its components, are more clearly shown in the exploded view as illustrated in FIG. 3. As illustrated, the canned motor assembly 22 comprises a motor 28, motor shaft 29, motor wiring 30, wire connectors 32, a foam block 34, a motor can 36, a motor cable 38, a plastic adapter 40, a threaded nipple 42, and an elbow 44. The motor cable 38 extends through a suction screen annular ring 39 which utilizes an annular ring flexible plastic cable plug 41. These motor components are connected to a motor cap 46 and a seal housing 48. A double o-ring 50 is situated between the motor cap 46 and the motor 28 and another o-ring 52 is situated between the motor cap 46 and the seal housing 48. Hex bolts and lock washers (collectively identified as 54) are used throughout the canned motor assembly 22 for connecting these various components together. Additionally, a pipe plug 56, pipe fill oil plug 58, and gaskets 59 (see FIG. 5*a*) are also used in the seal housing 48 and motor cap 46. The flanges of the seal housing 48 and the motor cap 46 along with the hex bolts and look washers 54 are the structure that is performing the function of fixedly securing the seal housing to the motor cap; and the flange of the motor can 46 along with the hex bolts and lock washers 54 are the structure that is performing the function of fixedly securing the motor cap to the motor.

In the preferred embodiment, upon connecting the motor cap 46 and the seal housing 48 to the motor 28, and as discussed in further detail below, a single seal 60 and a double seal 62 are created. All of the motor components and the motor cap 46 and the seal housing 48 are encased within the suction screen 26. The suction screen 26 is designed with a plurality of holes 27.

Figure 4:
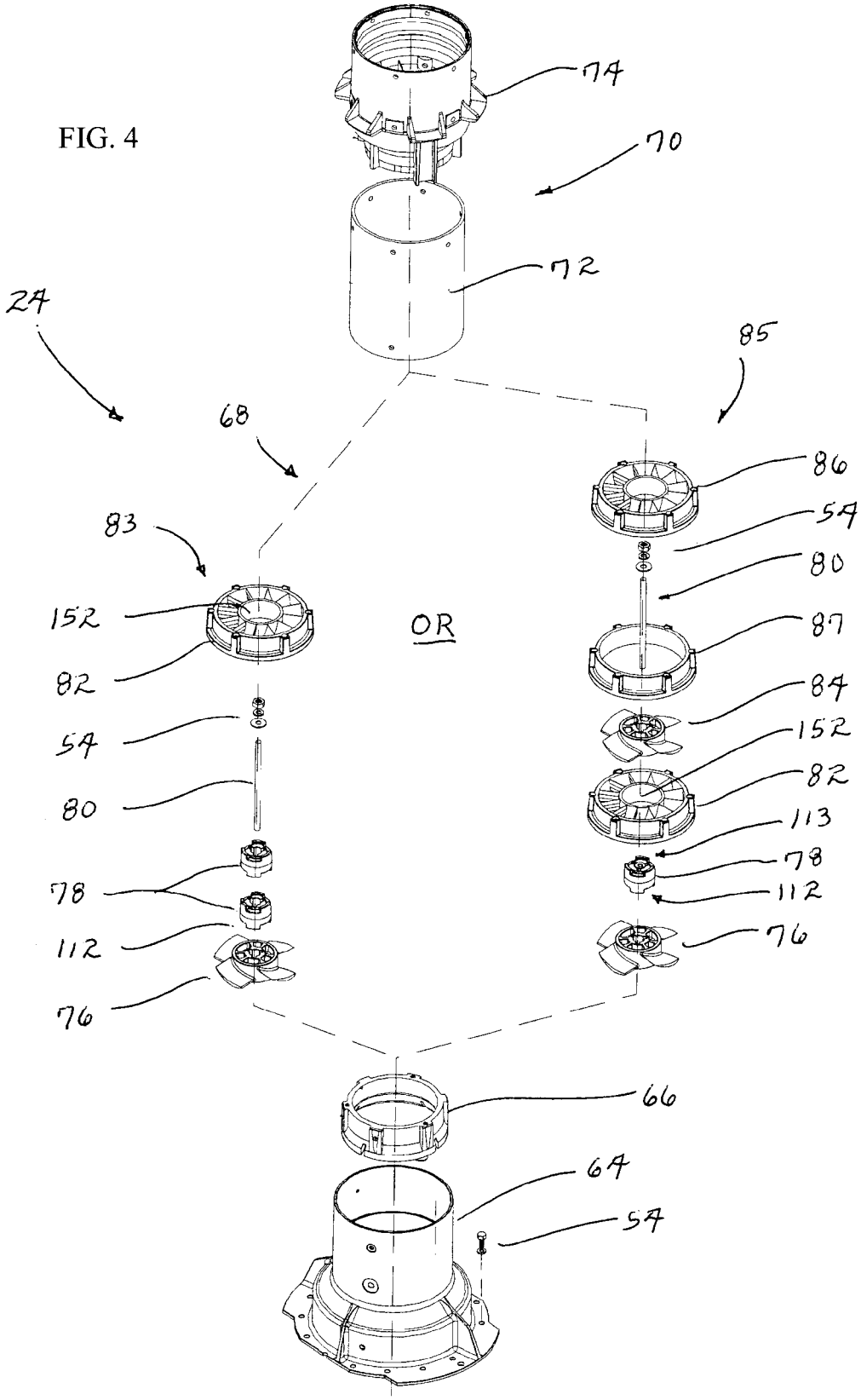
FIG. 4 is an exploded perspective view of the submersible pump apparatus illustrating, in particular, the pump assembly.

The pump assembly 24, and its components, are more clearly shown in the exploded view as illustrated in FIG. 4. As illustrated, the pump assembly 24 comprises the plastic motor base 64, a primary shroud 66, a stage pump 68, and a pump discharge assembly 70 which comprises a pipe 72 and a discharge support 74. In the preferred embodiment, the pipe 72 is made of plastic and preferably a polyvinyl chloride, commonly abbreviated PVC. Hex bolts and lock washers (collectively identified as 54) are used throughout the canned motor assembly for connecting these various components together, where needed.

The stage pump 68 is either a single or 1-stage pump 83 or a double or 2-stage pump 85. The single stage pump 83 comprises a propeller 76, a propeller spacer 78, a threaded rod 80, and an intermediate flow straightener 82. In the double stage pump 85, a second propeller 84, a second intermediate flow straightener 86, and a secondary shroud 87 are added, as illustrated. Alternatively, additional stages can further be added to this pump in the same manner, if desired, and would be referred to as a triple or 3-stage pump, and so on.

Turning next to FIG. 5*a*, the canned motor assembly 22 (with the double stage pump 85) and the pump assembly 24, and their components, are illustrated or shown in a cross-sectional view. In particular, the single seal 60 and the double seal 62, also referred to herein as "mechanical seals", are more clearly illustrated. In the preferred embodiment, when the seal housing 48 is connected or fixedly secured to the motor cap 46, the double seal 62 is a cylindrical member encircled around the exterior of the motor shaft 29 and forms or creates two seals: (i) a first seal 92 between the seal housing 48 and the motor shaft 29, and (ii) a second seal 90 between the motor cap 46 and the motor shaft 29. Likewise, when the motor cap 46 is connected or fixedly secured to the motor 28, the single seal 60 is a cylindrical member encircled around the exterior of the motor shaft 29 and forms or creates a third seal 88 between the motor cap 46 and the motor shaft 29.

Additionally, with the motor cap 46 and the seal housing 48 collectively secured to the motor 28, a first reservoir 94 is formed or created adjacent to the double seal 62, between the first seal 92 and the second seal 90, and between the motor cap 46 and the seal housing 48. In this manner, the first reservoir 94 comprises all of the open space that exists between the exterior of the motor cap 46 and the interior of the seal housing 48. A second reservoir 96 is formed or created between the second seal 90 from the double seal 62 and the third seal 88 from the single seal 60 within the motor cap 46. In this manner, the second reservoir 96 comprises all of the open space that exists within this section of the motor cap 46. And a third reservoir 98 is formed or created adjacent to the single seal 60 between the motor cap 46 and the motor 28. In this manner, the third reservoir 98 comprises all of the open space that exists within this section of the motor cap 46 and, further, all of the open space that exists between the exterior of the motor 28 and the interior of the motor can 36 (i.e., including along the exterior sides of the motor 28 and the bottom of the motor can 36). In the preferred embodiment, each of the first reservoir 94, the second reservoir 96, and the third reservoir 98 are substantially filled with oil. The seal housing 48, the motor cap 46, and the double seal 62 are the structure that is performing the function of creating the first reservoir 94; the motor cap 46 is the structure that is performing the function of creating the second reservoir 96; and the motor cap 46, the exterior of the motor 28, the interior of the motor can 36, and the single seal 60 are the structure that is performing the function of creating the third reservoir 98.

When this submersible pump apparatus 20 is in use, submerged and completely surrounded by the presence of fluid (i.e., such as water), if there is a breach or leak in the seals, Applicant's inventive design prevents the immediate destruction of the submersible pump apparatus 20.

While submerged, the submersible pump apparatus 20 is immersed or surrounded by the fluid. The submersible pump apparatus 20, while in a resting state (e.g., not engaged and pumping), permits the fluid to enter into an open end 100 of the discharge support 74 and fill the open space that exists within and between the pump assembly 24. When this occurs, the fluid surrounds the exterior of the seal housing 48. As the seal housing 48 is a solid component, the seals for this seal housing 48 are the only areas susceptible to breach by the fluid and leaking further toward the motor cap 46 and the motor 28. The first seal 92 that is situated between the seal housing 48 and the motor shaft 29 is the primary seal preventing the fluid from entering into the seal housing 48. The hex bolt and lock washers 54, o-ring 52, and pipe plug 56 (see FIG. 3) are also providing other seals for the seal housing 48. However, these seals, due to the interconnection and tightening of these parts forming the seal, are less likely to breach before the first seal 92.

Should the fluid breach the first seal 92 (i.e., due to the gradual wearing down of the first seal 92 which then permits or allows a leak in the first seal 92), the fluid would then proceed inside the seal housing 48 and into the first reservoir 94. In typical situations like this, the breach is very small and therefore the amount of fluid entering inside the seal housing 48 and first reservoir 94 is small and, even if continuous, is at a slow rate. As the fluid enters into the seal housing 48, the fluid slowly begins to fill the first reservoir 94. In this manner, the first reservoir 94 disperses the fluid throughout the first reservoir 94, and the oil contained therein, preventing initially presence of the fluid directly on the motor cap 46 or permitting a limited or reduced presence of the fluid directly on the motor cap 46. Thus, although fluid has breached the seal housing 48 and is slowly filling into the first reservoir 94, the submersible pump apparatus 20 continues undamaged and fully operational. As the fluid continues to further enter into the seal housing 48 and the first reservoir 94, at some point, there will be enough fluid in the first reservoir 94 that the fluid directly engages the motor cap 46. Also, in the event that enough fluid fills in at the bottom of the motor 28, the wire connectors 32 situated adjacent to the bottom of the motor 28 will permit a breach into the motor wires 30 and a controlled electrical fault interruption (e.g., like a ground fault interruption or GFI) to prevent the fluid engaging the motor 28 and thereby short circuit to save the motor 28.

A foam strip 102 is shown and used to absorb some of the pressure that would be created as the fluid inside this chamber is heated by the motor 28 and the friction of the double seal 62.

While the fluid is directly engaging the motor cap 46 within the first reservoir 94, as the motor cap 46 is also a solid component, the seals for the motor cap 46 are the areas that are next susceptible to a breach by the fluid and leaking further into the motor cap 46. The second seal 90 that is situated between the motor cap 46 and the motor shaft 29 is the primary seal preventing the fluid from entering into the motor cap 46. The hex bolt and lock washers 54, double o-ring 50 (see FIG. 3), and pipe oil fill plug 58 (see also FIG. 3) are also providing other seals for the motor cap 46. However, these seals, due to the interconnection and tightening of these parts forming the seal, are less likely to breach before the second seal 90.

Should the fluid breach the second seal 90 (i.e., due to the gradual wearing down of the second seal 90 which then permits or allows a leak in the second seal 90), the fluid would then proceed inside the motor cap 46 and into the second reservoir 96. Again, in typical situations like this, the breach is very small and therefore the amount of fluid entering inside the motor cap 46 and second reservoir 96 is small and, even if continuous, is at a slow rate. As the fluid enters into the motor cap 46, the fluid slowly begins to fill the second reservoir 96. In this manner, the second reservoir 96 disperses the fluid throughout the second reservoir 96, and the oil contained therein, preventing initially presence of the fluid directly on the third seal 88 within this section of the motor cap 46 or permitting a limited or reduced presence of the fluid directly on the third seal 88 within the motor cap 46. Also, if the oil has a density less than the fluid (i.e, water for example), the fluid will collect in a cavity 97 at the bottom of the second reservoir 96 intentionally forcing the fluid away from the third seal 88. Thus, although fluid has further breached the motor cap 46 and is slowly filling into the second reservoir 96, the submersible pump apparatus 20 continues undamaged and fully operational. As the fluid continues to further enter into the motor cap 46 and the second reservoir 96, at some point, there will be enough fluid in the second reservoir 96 that the fluid directly engages the third seal 88.

A foam strip 104 shown in the second reservoir 96 is used to absorb some of the pressure that would be created as the fluid inside this chamber is heated by the motor 28 and the friction of both the double seal 62 and single seal 60.

Should the fluid breach the third seal 88 (i.e., due to the gradual wearing down of the third seal 88 which then permits or allows a leak in the third seal 88), the fluid would then proceed further inside the motor cap 46 and into the third reservoir 98. Again, in typical situations like this, the breach is very small and therefore the amount of fluid further entering inside the motor cap 46 and third reservoir 98 is small and, even if continuous, is at a slow rate. As the fluid further enters into the motor cap 46, the fluid slowly begins to fill the third reservoir 98. In this manner, the third reservoir 98 disperses the fluid throughout the third reservoir 98, and the oil contained therein, preventing initially presence of the fluid directly on the motor 28 or permitting a limited or reduced presence of the fluid directly on the motor 28. Thus, although fluid has further breached the motor cap 46 and is slowly filling into the third reservoir 98, the submersible pump apparatus 20 continues undamaged and fully operational. As the fluid continues to further enter into the motor cap 46 and the third reservoir 98, at some point, there will be enough fluid in the third reservoir 98 that the fluid directly engages the motor 28. Eventually, the fluid will breach and damage the motor 28 requiring the motor 28 to be replaced.

Based on the foregoing, however, this submersible pump apparatus 20, as invented and designed by Applicant: (1) extends and/or prolongs the life of submersible pumps; (2) prevents the immediate destruction of the submersible pump in the event of a breach of the seals by the fluid; (3) even in the event of a breach, (a) provides a seal housing 48 and a motor cap 46 to protect the motor 28, (b) provides at least three different seals to protect the submersible pump apparatus 20, (c) provides at least three different reservoirs to disperse the fluid and limit or reduce the presence of the fluid within the submersible pump apparatus 20 and away from the motor 28, (d) delays the replacement of the submersible pump apparatus 20; and (e) thereby saves costs and money for the user.

Referring back to the stage pump 68 (see FIG. 4), in the preferred embodiment, the propeller 76 used in the single stage pump 83 is the exact same as the propeller 76 and the second propeller 84 used in the double stage pump 85. This propeller is more clearly illustrated in FIGS. 6 and 7. Alternatively, the propeller 76 used in the single stage pump 83, depending upon the horse power of the motor 28, may have a different pitch in the blades 106 (see FIG. 6) than the propeller 76 and the second propeller 84, where the horse power of the motor 28 in the double stage pump 85 is different. Additionally, in the preferred embodiment, the intermediate flow straightener 82 used in the single stage pump 83 is the exact same as the intermediate flow straightener 82 and the second intermediate flow straightener 86 used in the double stage pump 85. This intermediate flow straightener is more clearly illustrated in FIGS. 8 and 9.

In its assembled form, the double stage pump 85 and, in particular, the propeller 76, the propeller spacer 78, the intermediate flow straightener 82, the second propeller 84, and the second intermediate flow straightener 86 are also all more clearly illustrated in FIG. 10.

In use, when an electrical current is sent down an electrical wire (not illustrated) to the motor cable 38 and the motor wiring 30 to energize the motor 28 of the submersible pump apparatus 20, the propeller 76 (in the single stage pump 83) or the propeller 76 and the second propeller 84 (in the double stage pump 85) begin rotating. The rotation of the propeller 76 (in the single stage pump 83) or the propeller 76 and the second propeller 84 (in the double stage pump 85) begin to force the fluid within the pump assembly 24 toward the pump discharge assembly 70. This in turn likewise creates a pressure within the pump assembly 24 and the submersible pump apparatus 20 that begins to suck or pull the fluid surrounding the submersible pump apparatus 20 (e.g., water) through the holes 27 of the suction screen 26 and into the body of the pump assembly 24 of the submersible pump apparatus 20. The propeller 76 (in the single stage pump 83) or the propeller 76 and the second propeller 84 (in the double stage pump 85) are each provided with at least four (4) blades 106 (see FIGS. 6 and 7). Each of these blades 106 are fixedly attached to a propeller hub 108 and provided with a curvilinear arc 110. The blades 106 of the propeller 76 direct, through its rotation and use of the curvilinear arc 110, the flow of the fluid past the propeller 76 and toward the intermediate flow straightener 82. The blades 106 of the second propeller 84 direct, through its rotation and use of the curvilinear arc 110, the flow of the fluid past the second propeller 84 and toward the second intermediate flow straightener 86. The propeller spacer 78 have vertical tongues 112 (see FIG. 4) that are releaseably coupled or interlocking to corresponding notches 114 (see FIGS. 6 and 7) in the top of the propeller 76 and/or the second propeller 84. This is also more clearly illustrated in FIG. 20. In this manner, the propeller spacer 78 is secured to the propeller 76. In the single stage pump 83, there is an extra propeller spacer 78 which is releaseably coupled to or interlocking to the other propeller spacer 78. As illustrated in FIG. 22, the vertical tongues 112 of extra propeller spacer 78 is aligned with, inserted, and received into corresponding recesses 206 in the other propeller spacer 78. This alignment is accomplished by rotating the propeller spacer 78 through sixty degrees (60°) relative to the other propeller spacer 78. As this occurs, the vertical tongues 113 of the other propeller spacer 78 are aligned with, inserted, and received into corresponding recesses 208 in the extra propeller spacer 78. In this manner, each of the propeller spacers 78, in the single stage pump 83, are releaseably coupled or interlocked to one another.

In the preferred embodiment, the propeller spacer 78 is situated or mated, and freely rotatable, inside the center opening 152 (see FIGS. 4 and 8) of the intermediate flow straightener 82 (see also FIGS. 5(*a*) and 10). Additionally, the propeller spacer 78, having a female spline 214 (see FIGS. 20-22), is coupled to or interlocking with the motor shaft 29 (in the canned motor assembly 24) or the shaft extension 140 (in the alternate motor assembly 124) (see FIGS. 12-19).

Thus, when the motor 28 is energized, the motor 28 causes the motor shaft 29 to rotate. The motor shaft 29 in turn causes the propeller 76 (in both the single stage pump 83 and the double stage pump 85) and the propeller spacer 78, which are coupled to or interlocking with the motor shaft 29, to likewise rotate. In the double stage pump 85, the propeller spacer 78, which is also coupled to or interlocking with the motor shaft 29 and coupled to or interlocking with the second propeller 84 (as discussed in further detail below), causes the second propeller 84 (i.e., which is not coupled to or interlocking with the motor shaft 29 in the canned motor assembly 22 embodiment) to likewise rotate.

In the double stage pump 85, the propeller spacer 78 has vertical tongues 113 (see FIG. 4) that are releaseably coupled or interlocking to corresponding notches 115 in the bottom of the second propeller 84 (see FIG. 6), and as more clearly illustrated in FIG. 21. In the preferred embodiment, the notches 114 (see FIG. 6) in the top of the propeller 76 are the exact same as, or a mirror image of, the notches 115 (see FIG. 21) in the bottom of the second propeller 84. In this manner, the propeller spacer 78, in the double stage pump 85, likewise simultaneously drives both the propeller 76 (i.e., if needed, as the propeller 76 is already being driven by the motor shaft 29), and the second propeller 84.

Although being forced to move through the pump assembly 24 in the same direction, the rotation of the propeller 76 causes the fluid to swirl or into a turbulent state within the pump assembly 24. When the fluid passes the propeller 76 and into the intermediate flow straightener 82, the intermediate flow straightener 82 uses a plurality of vanes 116 (see FIGS. 8 and 9) arranged circumferentially between a center wall 118 and an exterior wall 120 of the intermediate flow straightener 82. Each of the vanes 116 are provided with a curvilinear arc 122. The curvilinear arc 122 of the vanes 116 is also more clearly illustrated in FIG. 11. In the preferred embodiment, the curvilinear arc 122 of each vane 116 starts or is positioned at substantially a seventy degree (70°) angle 156 to the vertical and ends in a position at substantially a zero degree (0°) angle 158 to the vertical. In this manner, the curvilinear arc 122 acts to counter balance or reduce the swirling or turbulent state of the fluid and force the fluid into a substantially straight, smooth state as the fluid is discharged from the intermediate flow straightener 82. This occurs during the "first stage" of the pump.

In the double stage pump 85, the second propeller 84 and the second intermediate flow straightener 86 are aligned in series with the propeller 76 and the intermediate flow straightener 82 such that the discharge from the "first stage" of the pump becomes the intake for the "second stage" of the pump. As the fluid passes through this second stage, (a) the rotation of the second propeller 84 again causes the fluid to swirl or into a turbulent state within the pump assembly 24, (b) the second flow straightener 86 uses the plurality of vanes 116 to again counter balance or reduce the swirling or turbulent state of the fluid and force the fluid into a substantially straight, smooth state, (c) the pressure exerted upon the fluid is increased by substantially double from the pressure resulting from the first stage of the pump, and (d) the fluid from the second intermediate flow straightener 86 is discharged up and through the pump discharge assembly 70 of the submersible pump apparatus 20 and directed to the surface.

In an alternate embodiment, a float 214, as illustrated in FIG. 5*b*, may be secured to pump assembly 24 in order to float the submersible pump apparatus 20 along the surface such that the submersible pump apparatus 20 may be used, for example, as a floating fountain.

When the electrical current is discontinued through the electrical wire (not illustrated) to the motor cable 38 and the motor wiring 30, the motor 28 becomes disengaged, the propeller 76 (in the single stage pump 83) or the propeller 76, the propeller spacer 78, and the second propeller 84 (in the double stage pump 85) stop rotating, the fluid is no longer being sucked or pulled into and forced through the body of the pump assembly 24, thereby, stopping the operation of the submersible pump apparatus 20.

In an alternate embodiment, the submersible pump 20 comprises a motor assembly 124, as illustrated in FIG. 12, for combination with the pump assembly 24, as illustrated and described in FIGS. 1-5. In this embodiment and as described in further detail below, the motor assembly 124 is fixedly secured to the pump assembly 24 through the use of the plastic motor base 64. Thus, in either the preferred embodiment or in this alternate embodiment, the plastic motor base 64 is used to connect the canned motor assembly 22 or the motor assembly 124 to the pump assembly 24.

In this embodiment, the motor assembly 124 is preferably a four inch (4") diameter motor and, depending upon the desired use and horse power, can have varying length, simply referred to herein as a short motor assembly 126, a medium motor assembly 128, or a long motor assembly 130.

The short motor assembly 126 comprises a motor cable assembly 132, a suction screen end plate 134, a suction screen 136 having a plurality of fins 137, a motor 138 having a short motor length 139, and a shaft extension 140. The medium motor assembly 128 comprises the same components as the short motor assembly 126 with the addition of an extension tube 142 to facilitate the length of the motor 138 which has a medium motor length 144. The long motor assembly 130 has the same components as the short motor assembly 126 with the addition of a second suction screen 146 to facilitate the length of the motor 138 which has a long motor length 148.

Each of the suction screen 136 and second suction screen 146 (in the long motor assembly 130) are provided with a plurality of fins 137 (see also FIG. 18). The plurality of fins 137 are used, when the motor 138 is inserted into the suction screen 136 and the second suction screen 146 (in the long motor assembly 130), to frictionally assist in securing the motor 138 within the motor assembly 124, and, by using the coupling or mating of the plurality of fins 137 with the motor 138, further assists in providing additional strengthening of the suction screen 136 and the second suction screen 146 (in the long motor assembly 130).

With the addition of the second suction screen 146, the second suction screen 146 facilitates additional suction for the long motor assembly 130. In the preferred embodiment, the suction screen 136 is identical to the second suction screen 146. Additionally, the suction screen 136 and the second suction screen 146 are each provided with a plurality of holes 154 that are small enough to prevent debris or other contaminants from being sucked or pulled into the pump assembly 124 and disrupt the flow of the fluid through the submersible pump apparatus 20. If desired, the suction screen 146 can be further stacked (i.e, connected end to end) to additional suction screens 146 (i.e., a third suction screen, fourth suction screen, etc.) to create a suction screen of virtually any length and thereby achieve a maximum suction area, as desired.

The suction screen 136 and the second suction screen 146 are each also provided with, amongst the plurality of holes 154, a plurality of annular ridges 204. The plurality of annular ridges 204 provides additional support, further strengthens the suction screen 136 and second suction screen 146, assists in making the suction screen 136 and second suction screen 146 resistant to collapse, and collects external debris or other contaminants for easy cleaning.

Preferably, the medium motor length 144 is longer than the short motor length 139 and the long motor length 148 is longer than the medium motor length 144. As the length of the motor increases, the horse power of the motor 138 for the medium motor assembly 128 is greater than the horse power of the motor 138 for the short motor assembly 126. Likewise, the horse power of the motor 138 for the long motor assembly 130 is greater than the horse power of the motor 138 for the medium motor assembly 128.

As the standard motor shaft 150 is short, the shaft extension 140 facilitates a smooth water flow over the motor 138 which could not be achieved without the shaft extension 140. In addition, the shaft extension 140 is long enough to allow and facilitate a driving mechanism for both the single stage pump 83 or the double stage pump 85 to be employed in the submersible pump apparatus 20. Additionally, the shaft extension 140 incorporates a male spline 160 (see FIG. 13) and a plurality of teeth 166 to engage and drive the propellers 76 (in the single stage pump 83) or the propeller 76 and second propeller 84 (in the double stage pump 85) creating a simple, effective, and positive drive. In addition, the male spline 160 and teeth 166 are designed by their size, thickness, and being fixedly secured to the shaft extension 140 to dramatically increase the stiffness of the shaft extension 140.

As illustrated in FIG. 13, the shaft extension 140 and the motor 138 of the motor assembly 124 are more clearly illustrated. In this embodiment, the shaft extension 140 comprises the male spline 160 and a spline base 162. In the preferred embodiment, the male spline 160 comprises a cylindrical member 161 having a hollow bore 164 and a plurality of teeth 166 extending outwardly from the exterior of the cylindrical member 161. The spline base 162 comprises a hole 168 and a tapered splined bore 170 contained therein (see also FIGS. 15 and 16). The motor 138 comprises a motor shaft 150 having a tapped hole 172, a male spline 174, and a plurality of threaded studs 178. The male spline 174 further provides a tapered top 175 and a plurality of roots 176.

The means for attaching the shaft extension 140 to the motor 138 of the motor assembly 124 is more clearly illustrated in FIGS. 14-16. As illustrated in FIG. 14, the spline base 162 of the shaft extension 140 is aligned with and positioned over the motor shaft 150 of the motor 138. When this occurs, as illustrated in FIG. 15, the tapered splined bore 170 of the spline base 162 is positioned to be mated with the male spline 174 of the motor shaft 150. A plurality of teeth 180 contained within the tapered spline bore 170 are aligned with and frictionally received into the corresponding plurality of roots 176 of the female spline 174 (see also FIG. 16). Also, the tapered surface 182 of the tapered spline bore 170 engages with and mates to the tapered surface 184 of the tapped hole 172 (see also FIG. 16). A threaded hex bolt 185, lock washer 186, Bellville washer 187, and a flat washer 188 are then used to fixedly secure the shaft extension 140 to the motor 138 as the threaded hex bolt 185 is inserted into and received into the threaded tapped hole 172 in the motor shaft 150 (see also FIG. 16).

Thus, in this alternate embodiment, when the motor 28 is energized, the motor 28 causes the motor shaft 150 to rotate. The motor shaft 150 in turn causes the shaft extension 140 which is coupled to or interlocking with the motor shaft 29, to likewise rotate. The shaft extension 140 in turn causes the propeller 76 and second propeller 84, which is also coupled to or interlocking with the shaft extension 140 (in both the single stage pump 83 and the double stage pump 85), to likewise rotate. The shaft extension 140 is coupled to or interlocking with the propeller 76 and the second propeller 84 when the male spline 160 and, in particular, the plurality of teeth 166 (see FIG. 13) are received into the female spline 200 of the propeller 76 and the second propeller 84 (see FIG. 6) and, in particular, the plurality of teeth 166 of the male spline 160 are likewise received into the corresponding roots 202 in the female spline 200. In this manner, the shaft extension 140, in this motor assembly 124, is secured to and acts as a driving mechanism of both the propeller 76 and the second propeller 84.

The means for attaching the plastic motor base 64 to the motor 138 of the motor assembly 124 is more clearly illustrated in FIGS. 17-18. In the preferred embodiment and as illustrated in FIG. 17(*a*)-(*d*), the plastic motor base 64 is provided with a center hole 189, a plurality of holes 190, and an external hole 192. As illustrated in FIG. 18, upon positioning and aligning the plurality of holes 190 of the plastic motor base 64 over the corresponding threaded studs 178 of the motor 138 and the tightening of hex nut 191 over the threaded studs 178, the plastic motor base 64 is fixedly secured to the motor assembly 124. The completed assembly of the plastic motor base 64 to the motor 138 of the motor assembly 124 is further illustrated in FIG. 19. This motor assembly 124 and plastic motor base 64 can then be secured to the pump assembly 24 to complete this embodiment of the submersible pump apparatus 20.

Additionally, in the canned motor assembly 22, upon insertion of a lock pin or rod (not illustrated) into the external hole 192 (see also FIG. 17(*c*), the lock pin or rod proceeds into the plastic motor base 64. As the lock pin or rod proceeds further into the plastic motor base 64, the lock pin or rod is received by a slot 210 (see also FIGS. 17*a* and 17*b*) and then proceeds through an internal bore 212 (see also FIG. 3) in the motor shaft 29 and into a second slot 214 (see also FIGS. 17*a* and 17*b*) on the opposite side of the motor shaft 29. In the alternate embodiment with the motor assembly 124, the lock pin or rod is inserted the exact same way except that the lock pin or rod proceeds into the hole 168 (see FIG. 13) in the spline base 162 of the shaft extension 140. In this manner, the lock pin or rod prevents the motor shaft 29 (in the canned motor assembly 22) or the shaft extension 140 and motor shaft 150 (in the motor assembly 124) from rotating when the hex bolt 185, holding the motor shaft 29 or the shaft extension 140 to the motor shaft 150, is tightened. This tightening also tightens the propellers 76, the second propeller 84 (in the double stage pump 85), and propeller spacers 78 to the male spline 160 of the shaft extension 140.

Thus, there has been provided a unique new and improved submersible pump apparatus. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A submersible pump apparatus for use within a body of fluid, comprising:

a motor and further defining a motor shaft extending outwardly from the motor;

a motor cap slideably coupled to the motor shaft;

means for fixedly securing the motor cap to the motor;

a seal housing slideably coupled to the motor shaft;

means for fixedly securing the seal housing to the motor cap;

a double seal slideably coupled to the motor shaft and situated between the seal housing and the motor cap, the double seal creating a first mechanical seal between the seal housing and the motor shaft and a second mechanical seal between the motor cap and the motor shaft; and a single seal slideably coupled to the motor shaft and situated between the motor cap and motor, the single seal creating a third mechanical seal between the motor cap and the motor shaft;

a first reservoir is formed between the seal housing and the motor cap;

the first reservoir comprises open space that exists between the seal housing and the motor cap and adjacent the double seal between the first mechanical seal and the second mechanical seal;

a second reservoir is provided inside the motor cap;

the second reservoir comprises open space that exists inside the structure of the motor cap between the second mechanical seal and the third mechanical seal;

a third reservoir is formed between the motor cap and the motor;

the third reservoir comprises open space that exists between the motor cap and the motor and adjacent the single seal between the third mechanical seal and the motor, and wherein the first reservoir circumferentially surrounds the second reservoir and at least a part of the third reservoir.

2. The submersible pump apparatus of claim 1 wherein the double seal is a cylindrical member encircled around the exterior of the motor shaft.

3. The submersible pump apparatus of claim 1 wherein the single seal is a cylindrical member encircled around the exterior of the motor shaft.

4. The submersible pump apparatus of claim 1 wherein the first reservoir, the second reservoir, and the third reservoir are each filled with oil.

5. A submersible pump apparatus for use within a body of fluid, comprising:

a motor, a motor cap, and a seal housing;

first fastening means for fixedly securing the motor cap to the motor;

second fastening means for fixedly securing the seal housing to the motor cap;

means for creating a first reservoir between the seal housing and the motor cap;

means for creating a second reservoir inside the motor cap;

means for creating a third reservoir between the motor cap and the motor;

wherein the first reservoir circumferentially surrounds the second reservoir and at least a part of the third reservoir, wherein, upon a first breach in the seal housing, the fluid enters into the first reservoir;

wherein, upon a second breach in the motor cap, the fluid from the first reservoir enters into the second reservoir;

wherein, upon a third breach in the motor cap, the fluid from the second reservoir enters into the third reservoir; and whereby, the fluid must breach the seal housing and motor cap and pass through the first reservoir, the second reservoir, and the third reservoir in sequential order before reaching the motor.

6. A method for delaying fluid from destroying a submersible pump apparatus used within a body of fluid, comprising the steps of:

providing a motor, a motor cap, and a seal housing;

securing the seal housing to the motor cap;

creating a first open space between the seal housing and the motor cap, the first open space defining a first reservoir;

providing the motor cap having an interior and an exterior, the interior of the motor cap segmented into and creating two distinct open compartments between the interior of the motor cap and the motor, one of the interior open compartments defining a second reservoir and the other of the interior open compartments defining a third reservoir, securing the motor cap to the motor;

the first reservoir circumferentially surrounding the second reservoir and at least a part of the third reservoir;

collecting the fluid into the first reservoir from a first breach in the seal housing;

collecting the fluid from the first reservoir into the second reservoir from a second breach in the motor cap; and collecting the fluid from the second reservoir into the third reservoir from a third breach in the motor cap.

7. The method of claim 6 and further comprising the step of providing a motor shaft extending outwardly from the motor.

8. The method of claim 7 and further comprising the step of creating a first mechanical seal between the seal housing and the motor shaft.

9. The method of claim 8 and further comprising the step of creating a second mechanical seal between the motor cap and the motor shaft.

10. The method of claim 9 and further comprising the step of creating a third mechanical seal between the motor cap and the motor shaft.

11. The method of claim 10 and further comprising the step of sequentially forcing the fluid through the first reservoir, the second reservoir, and then the third reservoir before reaching the motor.

12. The method of claim 11 and further comprising the step of substantially filling each of the first reservoir, the second reservoir, and the third reservoir with oil, the oil providing a density less than the fluid.

13. The method of claim 12 and further comprising the step of providing a cavity in the second reservoir to collect the fluid initially forced there by the oil and further preventing the fluid from engaging the third mechanical seal.

* * * * *